US009150333B2

(12) United States Patent
Beese et al.

(10) Patent No.: US 9,150,333 B2
(45) Date of Patent: Oct. 6, 2015

(54) DEVICE FOR PROVIDING PIPETTE TIPS

(75) Inventors: Jochen Beese, Norderstedt (DE); Detlef Schwarzwald, Hamburg (DE); Daniel Voss, Hamburg (DE); Frank Horstmann, Lensahn (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 13/495,764

(22) Filed: Jun. 13, 2012

(65) Prior Publication Data

US 2012/0328489 A1 Dec. 27, 2012

Related U.S. Application Data

(60) Provisional application No. 61/497,710, filed on Jun. 16, 2011.

(51) Int. Cl.

| | |
|---|---|
| ***B01L 9/06*** | (2006.01) |
| ***B65D 25/10*** | (2006.01) |
| ***B01L 9/00*** | (2006.01) |

(52) U.S. Cl.

CPC ..... *B65D 25/108* (2013.01); *B01L 9/543* (2013.01); *B01L 2200/025* (2013.01); *B01L 2200/141* (2013.01); *B01L 2300/043* (2013.01)

(58) Field of Classification Search

CPC ..... B01L 9/543; B01L 9/54; B01L 2300/043; A47F 7/0028

USPC ..... 422/500–501, 524–526, 560, 564; 206/406, 501, 503, 505, 509, 515, 557, 206/560

See application file for complete search history.

(56) References Cited

U.S. PATENT DOCUMENTS

| | | | | |
|---|---|---|---|---|
| 5,232,669 | A * | 8/1993 | Pardinas | 422/526 |
| 5,366,088 | A | 11/1994 | Hill et al. | |
| 6,019,225 | A * | 2/2000 | Kalmakis et al. | 206/563 |
| 6,286,678 | B1 | 9/2001 | Petrek | |
| 6,514,466 | B2 * | 2/2003 | Labriola et al. | 422/564 |
| 7,906,075 | B2 * | 3/2011 | Ueda | 422/511 |
| 8,409,873 | B2 * | 4/2013 | Woodside et al. | 436/180 |
| 8,460,622 | B2 * | 6/2013 | Motadel | 422/564 |

(Continued)

FOREIGN PATENT DOCUMENTS

| | | |
|---|---|---|
| DE | 8805448 | 6/1988 |
| DE | 29607444 | 8/1997 |

(Continued)

OTHER PUBLICATIONS

Brinkmann Instruments: Peak of Perfection. Westbury, New York 2002 (5102-C102). Found at URL: http://www.eppendorf.com/int/img/na/lit/pdf/5102-C102.pdf.

(Continued)

*Primary Examiner* — Brian R Gordon

(74) *Attorney, Agent, or Firm* — Vidas, Arrett & Steinkraus, P.A.

(57) ABSTRACT

Device for providing pipette tips including a refill pack which includes a perforated plate with a plurality of holes, pipette tips inserted into the holes, a container covering the pipette tips at the bottom with a stiffness of up to 300 N/mm and a removable cover, covering the pipette tips from the top and a holder with a receiver for inserting the refill pack, a laterally protruding upper bearing edge being present between the refill pack and holder for supporting the refill pack when said refill pack is inserted into the receiver.

22 Claims, 22 Drawing Sheets

(56) References Cited

U.S. PATENT DOCUMENTS

| | | | | |
|---|---|---|---|---|
| 8,470,265 | B2 * | 6/2013 | Motadel et al. | 422/526 |
| 2002/0009398 | A1 * | 1/2002 | Labriola et al. | 422/104 |
| 2008/0240999 | A1 | 10/2008 | Timpson et al. | |
| 2010/0221151 | A1 * | 9/2010 | Motadel et al. | 422/104 |
| 2010/0266457 | A1 * | 10/2010 | Rethwisch et al. | 422/104 |
| 2011/0236278 | A1 * | 9/2011 | Motadel et al. | 422/560 |

FOREIGN PATENT DOCUMENTS

| | | |
|---|---|---|
| DE | 19742493 | 2/1999 |
| DE | 20117178 | 1/2002 |
| DE | 10245961 | 4/2004 |
| EP | 0669856 | 9/1995 |
| EP | 2333560 A2 | 6/2011 |
| WO | 92/01514 | 2/1992 |
| WO | 2010/046529 | 4/2010 |

OTHER PUBLICATIONS

Brand: Pipette Tips. Precise—compatible—economical. A top Tip System. Wertheim, 2000 (2/1200). Found at URL: http://www.hll.de/pdf/3/pipettenspitzen%20eng.pdf?sid=44070d6fd0f38f43d7730edb1317a57d.

Eppendorf Netheler Hinz: Products and Applications for the Laboratory 2000. Catalog. Hamburg, 2000.

* cited by examiner

Fig. 2
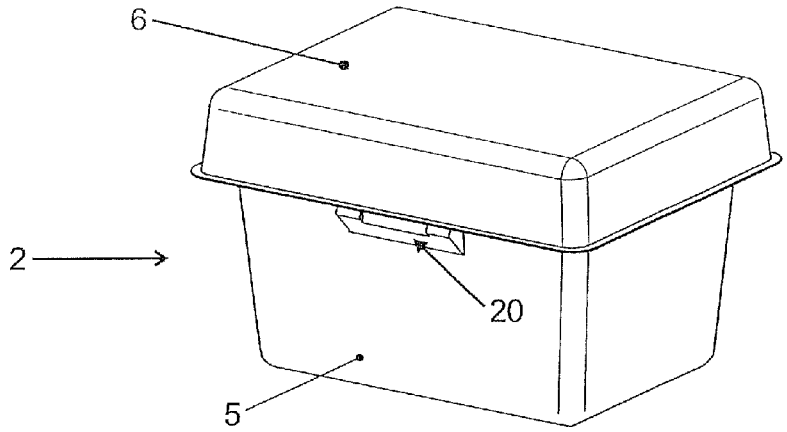
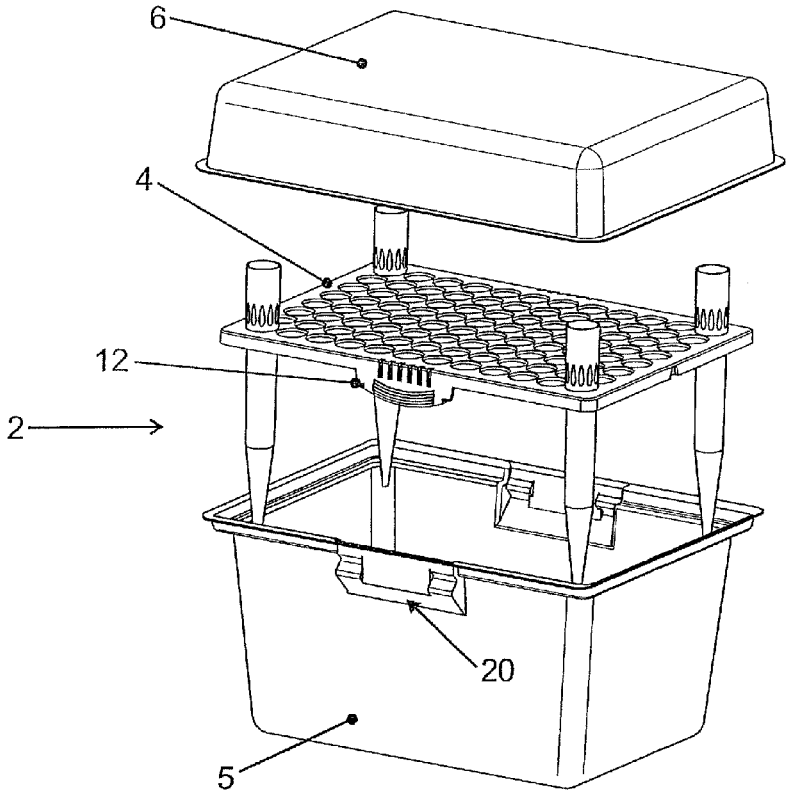

Fig. 3.1
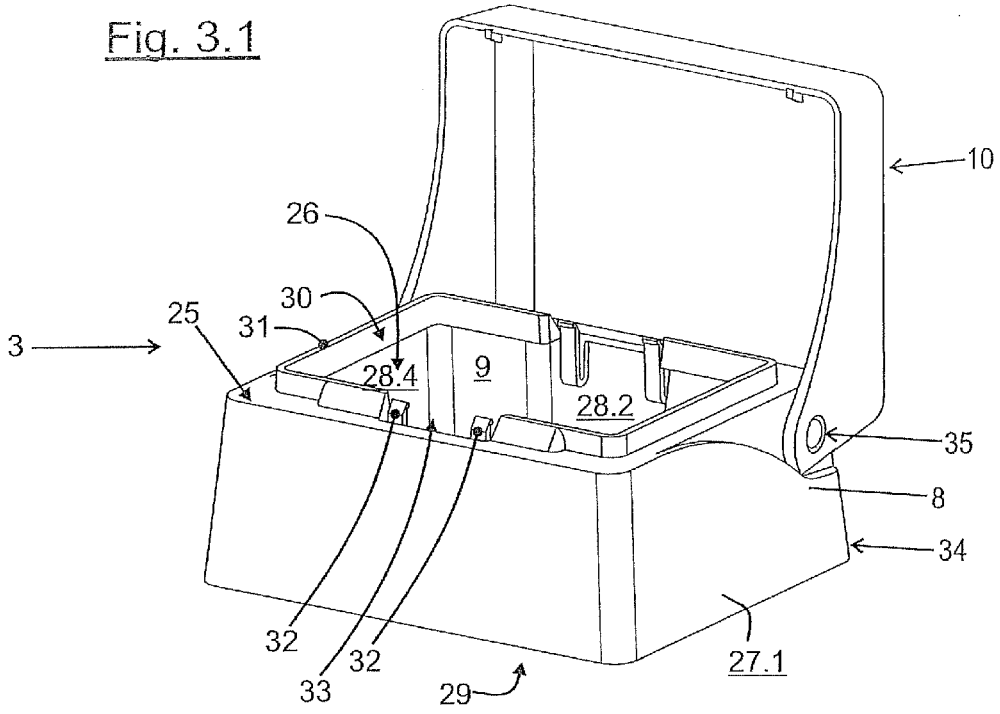
Fig. 3.2
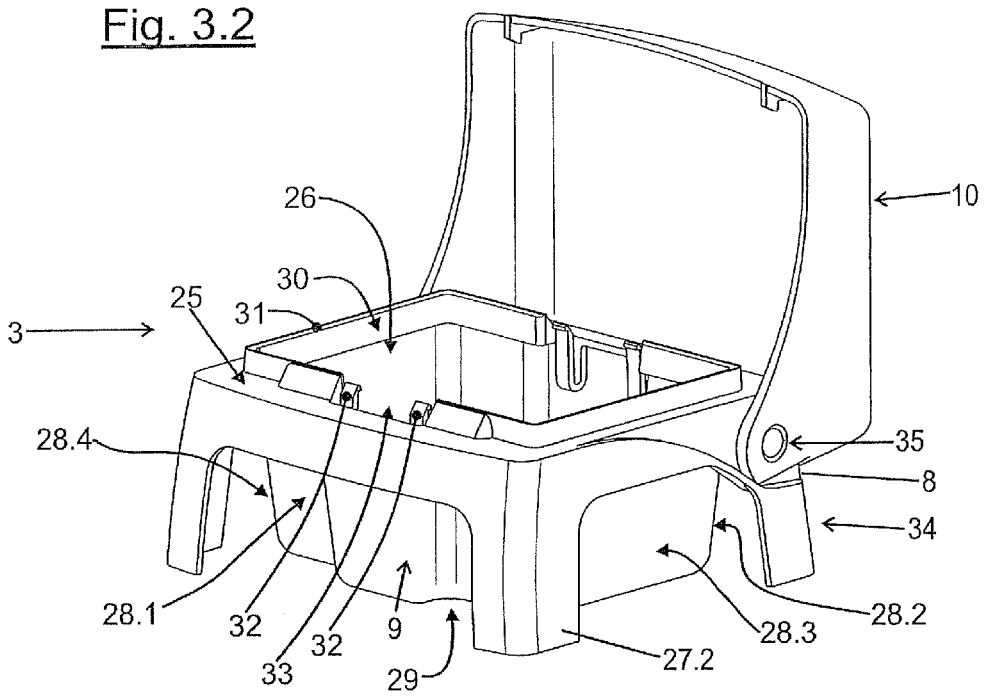

Fig. 28

| manu-facturer | product Typ | volume [µl] | height [mm] | maximumforce $F_{max}$ [N] | irreversible deformation | stiffness C [N/mm] | wallthickness [mm]** |
|---|---|---|---|---|---|---|---|
| A | holder 1 | 200 | 39 | 800 | - | 890 | >1 |
| | holder 2 | 1000 | 63 | >1.000 | - | 540 | >1 |
| | container 1 | 200 | 42 | 200 | + | 180 | 0,15 - 0,60 |
| | container 2 | 1000 | 67 | 80 | + | 50 | 0,20 - 0,60 |
| B | container 1 | 200 | 60 | 60 | + | 30 | 0,2 - 0,75 |
| | container 2 | 200 | 60 | 80 | + | 30 | 0,2 - 0,75 |
| | container 3 | 1000 | 97 | 100 | + | 50 | 0,2 - 1,2 |
| | container 4 | 1000 | 97 | 150 | + | 50 | 0,2 - 1,2 |
| C | container 1 | 200 | 53 | 300 | + | 90 | 0,2 - 0,7 |
| | container 2 | 1000 | 89 | >1.000 | - | 90 | 0,5 - 0,9 |
| D | holder 1 | 200 | 29 | >1.200 | - | 1.300 | >1 |
| | holder 1* | 200 | 29 | >1.200 | - | 1.050 | >1 |
| | holder 2 | 200 | 29 | >1.200 | - | 1.300 | >1 |
| E | holder 1 | 200 | 40 | 700 | - | 430 | >1 |
| | container 1 | 1000 | 53 | 40 | + | 20 | 0,05 - 0,40 |
| | carton holder | 1000 | 63*** | 100 | + | 40 | 0,5 |
| F | holder 1 | 200 | 41 | >1.000 | - | 600 | 1,8 - 2,0 |
| | holder 2 | 200 | 41 | >1.000 | - | 440 | 1,2 - 1,3 |
| | container 1 | 200 | 63*** | 200 | + | 40 | 0,50 - 0,65 |
| | container 2 | 200 | 41 | 200 | + | 130 | 0,7 |
| | container 3 | 1000 | 55 | 200 | + | 80 | 0,28 - 0,35 |

* inserted into an additional holder

** in case of thermoformed plastic containers with uneven wall thickness due to the method of manufacture the ranges of the wall thickness are specified

*** double rack

DEVICE FOR PROVIDING PIPETTE TIPS

CROSS-REFERENCE TO RELATED APPLICATIONS

This application claims priority to provisional patent application No. 61/497,710, filed Jun. 16, 2011.

STATEMENT REGARDING FEDERALLY SPONSORED RESEARCH

Not applicable

BACKGROUND OF THE INVENTION

The invention relates to a device for providing pipette tips.

Pipette tips are small tubes made of plastics material which serve for receiving samples of fluid, preferably in quantities of approximately 0.1 μl to 100 ml, in the laboratory. At the bottom they comprise a through-opening for fluid and at the top a through-opening for air, the cross section of the pipette tips generally increasing from the lower to the upper through-opening. For metering fluid, the upper end of the pipette tip is connected, for example, to a piston-operated pipette, so that the upper through-opening is attached to a device for displacing air from the pipette. To this end, the pipette tip with the through-opening is clamped onto an attachment of the pipette or clamped into a hole of the pipette. A channel opens into the front face of the attachment and/or into the bottom of the hole, said channel being connected to the displacement device of the pipette. By means of the displacement device, an air cushion is displaced so that a defined quantity of fluid is received into the pipette tip and is ejected therefrom. The metered quantity of fluid depends on the displacement of the displacement device. The pipettes may have uniform displacement, as fixed volume pipettes, or adjustable displacement, as variable pipettes. Moreover, the pipettes may be piston-operated pipettes or direct displacement pipettes. After use, the pipette tip is detached from its seat on the pipette, for which the pipette may comprise an ejector which upon actuation forces the pipette tip away from its seat. Afterwards, the pipette is able to receive a new pipette tip. Spillages of samples of fluid between successive meterings are thus avoided.

Filter pipette tips comprise a filter in the vicinity of their upper end which prevents aerosol or fluid from the pipette tip from entering into the pipette, and contaminating said pipette. Filter pipette tips generally have to be packaged in a sterile manner until used.

For attaching pipette tips to the seat of a pipette, pipette tips are provided on holders for pipette tips. Said holders comprise a perforated plate made of plastics, also called a "tray" or "wafer", with a plurality of holes in a matrix arrangement. The perforated plate generally has 96 holes in 8 rows and with 12 slots. Pipette tips are inserted from the top into the holes, said pipette tips not falling through due to an upwardly widening diameter or a collar.

The perforated plate is, for example, connected integrally to a downwardly protruding peripheral frame which prevents inserted pipette tips from coming into contact with the support surface. Such a holder is described in DE 102 45 961 B4, the entire contents of which is incorporated herein by reference.

Moreover, holders for pipette tips exist in which perforated plates are able to be inserted releasably into a stackable frame.

Such a holder for pipette tips is described in DE 197 42 493 C1, the entire contents of which is incorporated herein by reference.

Also known are holders for pipette tips which are configured as boxes or frames which are closed at the bottom. A perforated plate provided with pipette tips is able to be positioned on the upper edge of the holder, so that the pipette tips protrude into a receiver of the holder.

The pipette tips may be removed from a holder by pressing the seat of a single channel pipette or the seats of a multichannel pipette from the top onto the upper ends of the pipette tips individually or a plurality thereof at the same time. In this case, considerable pressing forces may act, which the holder has to withstand so that the pipette tip is fixed sufficiently securely to its seat on the pipette. Accordingly, the holder or the sub-assembly consisting of the tray and holder have to be of stable configuration.

Holders in the form of boxes or frames are known which are discarded and/or reused after the removal of all pipette tips. The reusable holders are able to be filled by means of refill packs comprising fresh pipette tips. The refill packs may comprise a plurality of perforated plates which are filled with pipette tips. For example, refill packs are known in which one or more perforated plates filled with pipette tips are arranged in folding cardboard boxes or cardboard frames. Said refill packs are not sufficiently protected against contamination from dust, etc. Thus, it is not possible for sterile pipette tips to be made available.

In further known refill packs, a perforated plate filled with pipette tips is fastened releasably to the upper edge of the plastics container, the pipette tips protruding into the container. A further perforated plate is arranged thereover, the pipette tips thereof protruding into the pipette tips of the lower perforated plate, and which at the edge is releasably fastened to the lower perforated plate. Further plates with pipette tips are accordingly arranged thereover and the arrangement is covered from the top by a plastics cover which is releasably fastened to the uppermost perforated plate.

Refill packs of the type described above are disclosed, for example, in WO 92/01514 A1, U.S. Pat. No. 5,366,088 and U.S. Pat. No. 6,286,678 B1, the entire contents of each of which are incorporated herein by reference.

Embodiments of said refill packs are also known in which the lid is used for moving the perforated plates filled with pipette tips from the refill stack into the holder. The perforated plate is latched in the holder and the cover may be pulled off and to protect the opened refill pack from contamination is positioned onto the upper perforated plate of the refill stack.

Said refill packs have the drawback that they have to be opened for moving perforated plates with pipette tips held therein onto a holder. In this case, the pipette tips are at least partially accessible from the outside, so that they are not protected from contamination. In particular, when moved, the pipette tips may come into contact with the holder or other objects and as a result become contaminated.

The "Tip SystemBox" (product name from Sarstedt AG & Co, Nümbrecht, Germany) is a box with a folding lid made of autoclavable material into which, optionally for autoclaving, pipette tips are able to be inserted in a tray or in a stack consisting of trays filled with pipette tips (called "Tip StackPack") in order to obtain a non-slip pipette position which is secure from tipping up. Optionally, there is the possibility of inserting so-called "Biosphere® Boxes" without contamination into the Tip SystemBox. The Biosphere® Boxes are stable boxes closed at the bottom which at the top carry a tray with pipette tips. A lid is positioned from the top onto the tray. In this application, the Tip SystemBox serves as a holder which is intended to prevent the downwardly tapering Biosphere® Box from tipping over when a pipette receives pipette tips. The stable Biosphere® Boxes are relatively costly disposable articles.

Sterile pipette tips have hitherto been generally handled in stable disposable boxes for processing and not in refill packs for moving into a box or frame. In contrast to reusable boxes, said disposable boxes are discarded after the removal of all pipette tips. The design thereof is costly in terms of material so that they are expensive to manufacture and produce waste packaging in large quantities for the user. Frequently, the components of said disposable boxes are not able to be dismantled easily enough. The user often compresses the remaining packaging in order to reduce the volume of waste. In this case, the conventional disposable boxes do not always permit the use of automated methods during manufacture.

The material consumption is correspondingly high for the packaging of sterile pipette tips and the quantity of waste produced during use.

Proceeding therefrom, the object of the invention is to provide a device for providing pipette tips which may be easily refilled, the risk of contamination of the pipette tips being reduced and the packaging waste being reduced. Moreover, the object of the invention is also to propose the use of a refill pack which permits easier refilling of pipette tips, the risk of contamination of the pipette tips being reduced and the packaging waste being reduced. Finally, the object of the invention is to provide a method for producing a refill pack which is suitable for use in a device according to the invention for providing pipette tips.

BRIEF SUMMARY OF THE INVENTION

The device according to the invention for providing pipette tips comprises a refill pack, which comprises a perforated plate with a plurality of holes, pipette tips inserted into the holes, a container covering the pipette tips at the bottom and having a stiffness of up to 300 N/mm and a cover, covering the pipette tips from the top and a holder with a receiver for inserting the refill pack, the refill pack and holder comprising means for supporting, which support the refill pack when said pack is inserted into the receiver.

The device according to the invention for providing pipette tips comprises a refill pack which comprises a perforated plate filled with pipette tips. The pipette tips are covered at the bottom by a container which has a stiffness of up to 300 N/mm. The stiffness of the container is the quotient of a maximum force introduced vertically into the container, from which the container deforms in a non-linear and permanent manner and the associated compression of the container. In the device according to the invention the container has so little stiffness that it is able to be relatively easily produced with low material consumption. The refill pack is able to be inserted with the container and the cover into the holder so that when refilling the holder the pipette tips are covered at the top and bottom, and are protected from contamination. Contamination of the pipette tips when filling the holder may therefore be avoided or reduced.

In order to receive pipette tips by means of a pipette the cover is able to be opened. After receiving pipette tips, the cover is able to be repositioned on the refill pack in order to protect pipette tips remaining on the perforated plate from contamination. When receiving pipette tips from the perforated plate by pressing a pipette onto the upper end of one or more pipette tips, vertical forces are exerted via the perforated plate onto the container. Due to its relatively low stiffness the container could yield under these forces which could have the result that the pipette tips are not securely received by a pipette. This is avoided by the means for supporting the refill pack in the receiver of the refill pack and holder. The means for supporting are namely such that they deflect forces onto the perforated plate when a pipette receives pipette tips, so that they do not act on the container, or only in a reduced manner, and deformations of the container which impair the reception of the pipette tips are eliminated. The holder is of correspondingly stable configuration. The holder is reusable so that the cost required for a stable design of the holder is financially affordable.

The forces acting on the perforated plate when the pipette tips are received are preferably diverted into the holder by the perforated plate being supported on the edge on the means for supporting the holder, which are formed by a lower bearing surface of the holder. Moreover, the perforated plate is preferably indirectly supported on the lower bearing edge of the holder, via an upper bearing edge of the container protruding to the side in the manner of a flange.

According to a further embodiment, the perforated plate is, supported on its edge directly on the lower bearing edge of the holder. In this case, according to a preferred embodiment, the container is connected to the lower face of the perforated plate, so that the outer edge region of the perforated plate protrudes outwardly relative to the container. According to a further embodiment, in this case the container is retained on the pipette tips held in the perforated plate.

Moreover, the invention comprises possible embodiments in which, according to a further embodiment, the container on the outer surface of its side walls is supported in a planar manner in a receiver of the holder, so that the forces acting from the perforated plate onto the container are deflected from the outer surface or a substantial part of the outer surface of the side walls of the container, and containers with only low stiffness are able to be used. Optionally, the container is additionally supported with its base in the receiver.

If all pipette tips are removed from the refill pack, said refill pack may be removed from the holder and replaced by a new refill pack.

The container may be designed so that it only covers the through-openings for fluid of the pipette tips from the bottom. Moreover, it may also be designed such that it additionally covers lower regions of the pipette tips to the side, for example by having receivers, for example in the form of hollow cone-like portions for each individual pipette tip or side walls enclosing the entire set of pipette tips of the refill pack at the side and at the bottom. The container may be designed so that it covers the pipette tips to the side only over part of the space between the through-openings for fluid and the perforated plate. It may, however, also be designed so that it covers the pipettes to the side over the entire space. Moreover, the container may be designed so that it covers the perforated plate to the side. Moreover, the container may protrude at the top over the perforated plate. Optionally, side walls of the container protrude upwardly as far as the level of the through-openings for air of the pipette tips or beyond said level.

The cover may be designed so that it covers from the top only the through-openings for air from the pipette tips. Moreover, it may be designed so that it covers to the side additional upper regions of the pipette tips, for example by having receivers, for example in the form of hollow cylinders for each individual pipette tip, or side walls enclosing the entire set of pipette tips of the refill pack at the side from the top. The side walls may be designed so that they extend over part of the space between the through-openings for air from the pipette tips and the perforated plate or over the entire space. Moreover, said side walls may be designed so that they laterally grip the perforated plate and/or they extend downwards beyond the perforated plate.

If the container covers the pipette tips from the bottom only at a distance from the perforated plate, it may be fastened directly to the pipette tips or via connecting elements (for example snap hooks) to the perforated plate (for example to the edge of the perforated plate or in recesses on its underside).

If the cover covers the pipette tips from the top only at a distance from the perforated plate, it may be fastened directly to the pipette tips or via connecting elements (for example snap hooks) to the perforated plate (for example to the edge of the perforated plate or in recesses on its upper face).

Provided the container and/or cover reach as far as the perforated plate or further, they may be held and/or fastened to the perforated plate and/or to one another (for example via means for supporting and/or snapping and/or latching to the edge of the container and/or cover and/or perforated plate).

Preferably, the container and/or the cover is closed and/or free of through-openings, so that no contamination passes through the walls of the container and/or cover.

Further preferably, the upper edge of the container is located on the lower edge of the cover and/or the upper edge of the container and the lower edge of the cover bear against the perforated plate. Preferably, the support is such that the passage of air is prevented or restricted between surfaces adjacent to one another.

According to an embodiment, the container has a stiffness of up to 200 N/mm, preferably of up to 100 N/mm. Quite preferably, the container has a stiffness of up to 80 N/mm. As a result, the use of material and the cost of producing the container is further reduced.

According to a further embodiment, the container has a minimum stiffness of 20 N/mm, preferably of at least 40 N/mm. As a result, the container obtains sufficient stiffness in order to protect said container from deformation when stored and transported, which could impair the arrangement of the pipette tips in the perforated plate.

According to a further embodiment, the container has a stiffness in the range of 0 to 20 N/mm.

Preferably, it has a stiffness which is as low as possible, i.e. a stiffness which is approximately 0 N/mm. As a result, the material consumption for the container may be minimised. The container may be protected from damage by an outer packaging (for example made of cardboard) when stored and transported. The container of low stiffness which is preferably approximately 0 N/mm, is preferably a blister pack (plastics film moulded part). A blister pack is a moulded part made of plastics film. Such a plastics film moulded part is able to be produced with a very low wall thickness and/or low material consumption and low stiffness.

In principle, however, also a container with a higher stiffness (for example of at least 20 N/mm) may be a blister pack.

The parts of the refill pack may be held against one another and/or connected together in different ways. According to an embodiment, means for supporting and/or means for positively connecting the perforated plate and container and/or means for supporting and/or means for positively connecting the cover and container in the covered position of the cover on the container and/or means for supporting and/or for positively connecting the cover and perforated plate in the covered position of the cover on the perforated plate are present. The means for supporting and/or for positively connecting have the advantage that the perforated plate, container and cover are specifically produced and easily mountable. The production and mounting may be carried out in an automated process. Separate means for supporting and/or for positively connecting the perforated plate and container and means for supporting and/or for positively connecting the cover and container and means for supporting and/or for positively connecting the cover and perforated plate have the advantage that the cover may be opened without the perforated plate being detached from the container. As a result, when the cover is opened the perforated plate is secured to the container. Consequently, the perforated plate is prevented, in particular, from being lifted away from the container with the pipette tips.

The means for supporting are preferably horizontal bearing surfaces and/or vertical lateral guide surfaces. The means for positively connecting the container and/or perforated plate and holder preferably have undercuts of the container and/or perforated plate and holder which come into engagement with one another when connected.

The positive connecting means are means for snapping or latching, also called "snap connections" or "latching connections". When connecting by means of a snap connection or latching connection, a component is deformed at least partially elastically and hooked onto the other component. To this end, the one component may have a resilient projection (for example snap hook, protrusion or bead) and the other component may have a recess (undercut) or a recess for latching the projection.

In principle, the parts of the refill pack may also be connected together in a different manner, for example by a non-positive connection (for example pressing-in) or material connection (for example welding) of the perforated plate and container or by simply inserting the perforated plate between the container and the cover. Moreover, the container may be connected non-positively to the cover (for example by pressing-in) or by a material connection (for example by a detachable welded connection or by sealing-on a film as a cover).

According to an embodiment, the cover is able to be released completely from the container. According to a further embodiment, the cover is connected to the container on one edge via an articulated connection. Additionally, the cover and the container on an edge opposing the articulated connection may comprise means for latching together in the closed position. The cover and container may be made separately from one another with the respective means for latching and/or articulated parts of an articulated connection. Then the articulated connection may be optionally produced. In principle, it is also possible to produce the cover and container in one piece, the articulated connection being able to be implemented by a film hinge, a flexible hinge strip or hinge straps.

According to an embodiment, the means for supporting comprise a laterally protruding upper bearing edge of the container, on which the perforated plate is supported on the edge, and a lower bearing edge of the holder protruding to the side from the upper edge of the receiver, on which the container may be positioned with its upper bearing edge. If the refill pack is inserted into the receiver, the container rests on the upper bearing edge of the holder and the perforated plate is supported via the upper bearing edge of the container on the lower bearing edge of the holder. As a result, the positioning forces when a pipette receives pipette tips are diverted via the edge of the perforated plate through the material of the upper bearing edge into the lower bearing edge of the holder. A deformation of the container which could impair the reception of the pipette tips, is as a result avoided.

According to an embodiment, the holder comprises a lower part with the receiver for the container and a lid covering the receiver with an inserted refill pack. In this embodiment, the refill pack is additionally protected from contamination by the lid of the holder. After removing pipette tips from the refill pack, said refill pack may be covered again by its cover and additionally by the lid. However, it is also possible to remove the cover from the refill pack and to protect the pipette tips remaining on the perforated plate simply by the lid of the holder.

According to an embodiment, the lid comprises an articulated connection to the lower part of the holder. In principle, the lid may be held by its own weight in the closed position or forced by spring action into the closed position. Moreover, the lower part and lid on the edge which opposes the articulation connection may comprise means for latching or locking the lid and lower part. According to a further embodiment, the lid is completely releasable from the lower part and in the closed position is able to be connected by means for latching and/or locking to the lower part.

According to an embodiment, means are present for latching the container and/or the perforated plate and holder in the arrangement of the refill pack in the receiver. These means for latching may prevent the container and/or perforated plate from being lifted when the pipette tips are removed from the perforated plate. According to a further embodiment, the means for latching the container and/or perforated plate and holder are stronger than the force for opening the cover of the refill pack. As a result, it is possible to open the refill pack without manually holding onto the container and/or the perforated plate. Contamination of the refill pack is thus avoided.

The means for latching the lid and cover preferably comprise undercuts of the lid and cover which in the latched state engage behind one another.

According to a further embodiment, the lid of the holder and the cover of the refill pack comprise means for latching the lid to the cover which may be latched together by closing the lid when the refill pack is inserted into the receiver, the force for releasing the latching between the lid and cover by opening the lid being greater than the force for releasing the latching between the cover and container by opening the cover. In this embodiment, the lid of the holder is automatically latched to the cover of the refill pack inserted in the holder, when the lid is closed. Moreover, in this embodiment it is ensured that when opening the lid the cover is opened therewith, as the force for releasing the latching between the lid and cover exceeds the force for releasing the latching between the cover and container. When opening and closing the lid, therefore, the cover of the refill pack is opened and closed at the same time. Thus dual protection of the refill pack from contamination is achieved. Additionally, the pipette tips are protected from contact with the lid of the holder. Moreover, an operating step is thereby dispensed with.

According to an embodiment, the means for latching the perforated plate and container comprise latching tabs protruding downwards from two opposing edges of the perforated plate, with outwardly protruding latching lugs and recesses in the side walls receiving latching lugs below the upper edges of the container. This embodiment permits the use of already known perforated plates in the refill pack of the device. According to a further embodiment, the means for latching the container and holder comprise outwardly protruding shaped portions in the side walls below the upper edges of the container and resilient locking hooks of the holder overlapping the shaped portions. According to a further embodiment, the shaped portions in the side walls of the container are formed at the same time as recesses for receiving the latching lugs of the perforated plate. Thus the holder is optionally able to be filled with the refill pack of the device according to the invention or with the perforated plate of a conventional refill pack without the container and cover.

According to a further embodiment, the container and/or the cover have a wall thickness of 0.05 mm to 1.0 mm.

According to a preferred embodiment, the perforated plate, container and cover are produced from plastics. Preferably, the perforated plate is injection-moulded and/or the container is deep-drawn or a blister pack (moulded part made of plastics film with low stiffness) or injection-moulded and/or the cover is deep-drawn or injection-moulded. In particular, in the embodiment of the container as a blister pack, the cover may also be a film which is sealed on the upper edge of the blister pack. The film may be produced by means of a suitable production method (for example blow-moulding, lamination of multi-layered films, etc.)

According to a preferred embodiment, the holder is also produced from plastics. Preferably, the holder is injection-moulded. As the holder is able to be reused, an at least partial configuration of the holder from materials other than plastics is also considered. Thus, the holder may be produced entirely or partially from metal.

According to an embodiment, the perforated plate and/or the container and/or the cover and/or the holder consists entirely or partially of polypropylene and/or polyethylene and/or polycarbonate and/or acrylonitrile-butadiene-styrene-copolymer and/or polystyrene and/or polyethylene terephthalate and/or degradable plastics and/or bio-based plastics and/or composite films made of polyamide and polyethylene or polyethylene terephthalate and polyethylene.

According to an embodiment, before being inserted into the holder the refill pack is enclosed in a pouch and/or in a shrink wrap film. According to a preferred embodiment, the refill pack is enclosed in a sterile manner in the pouch and/or the shrink wrap film. According to a further embodiment, a plurality of refill packs may be contained together in a pouch and/or a shrink wrap film. According to a further embodiment, the refill pack is inserted in the pouch and/or in the shrink wrap film into an outer packaging made of cardboard and/or corrugated card. For inserting into the holder, the refill pack may be removed from the pouch and/or the shrink wrap film. Then a sterile barrier which protects the pipette tips from contamination is dispensed with. The pipette tips of the refill pack are, however, also protected by the container and the cover against contamination.

According to a further embodiment, the refill pack comprises a tamper evident closure. Said tamper evident closure serves for the secure storage of the pack contents, primarily when maintaining the sterility is particularly critical. If the refill pack is opened, the tamper evident closure is destroyed. Thus it is immediately obvious whether the refill pack is still closed by the tamper evident closure.

Moreover, the object is achieved by the use of a refill pack according to claim 20.

In the use according to the invention of a refill pack for providing pipette tips, with a perforated plate filled with pipette tips and packaging enclosing the perforated plate with the pipette tips, the refill pack is inserted in its packaging or a part of the packaging into a holder, pipette tips are removed from the perforated plate by positioning a pipette and the holder diverts past the packaging positioning forces which act when the pipette is positioned.

In the use according to the invention, the pipette tips are protected from contamination when inserted into the holder.

Preferably, they are protected from contamination by the packaging until the opening of the packaging arranged in the holder, immediately before the removal of pipette tips. The packaging is preferably formed by a container and by a cover, which is disclosed in detail in the claims for the device for providing pipette tips. The packaging may, however, also be packaging made of cardboard or a different material. Preferably, the refill pack is inserted into the holder in its entire packaging in which it has previously been transported and/or stored. The use, however, also relates to possible variants in which the refill pack is only inserted into the holder in a part of its packaging, for example in a lower part of the packaging, which protects the pipette tips from the bottom. The lower part of the packaging protects the pipette tips from hand contact or contact with the holder when inserted into the holder in the regions which come into contact with fluid, which could lead to undesirable contamination. When positioning a pipette on one or more pipette tips, the pipette tips are clamped onto an attachment of the pipette, or clamped in a bore of the pipette, so that it is fixed to the attachment and/or in the bore. The positioning forces acting here are diverted from the holder past the packaging, so that they do not deform the packaging, and do not prevent sufficiently high clamping forces for fixing the pipette tips to the attachment and/or in the bore from being reached. Preferably, the holder diverts the positioning forces completely past the packaging and/or the parts of the packaging which have low stiffness, so that any deformation of the packaging is avoided. To this end, the perforated plate may be supported on the holder via an intermediate edge region of the packaging protruding to the side in the manner of a flange, or the perforated plate may be directly supported on the holder. However, it is sufficient that the holder only partially diverts the positioning forces and namely to the extent that deformation of the packaging, which stops sufficiently high clamping forces for fixing the pipette tip to the attachment and/or in the bore from being reached, is prevented. To this end, for example, the packaging may be supported by the outer surface of its side walls in a planar manner in a receiver of the holder, preferably said packaging being able to be supported by the entire outer surface of its side walls or a substantial part of said outer surface in the holder. Optionally, the container is additionally supported by its base in the receiver. Preferably, the positioning forces are diverted from the holder into a support surface on which the holder rests.

According to an embodiment of the use, before being inserted into the holder the refill pack may be removed from a sterile outer packaging. The refill pack is protected in the sterile outer packaging until inserted into the holder under sterile conditions. When inserted into the holder, the refill pack is still protected by the packaging. This use makes it possible to insert the pipette tips in a sterile or virtually sterile state into the holder. The pipette tips may be inserted into the holder in a sterile state when the packaging of the refill pack itself is sterile. This may be achieved, in particular, when the refill pack is designed as a blister pack. In this case, the pipette tips in the refill pack may be inserted in the sterile state into the holder, even when the refill pack was not previously contained in a sterile outer packaging. Advantageously, also in a sterile packaging, the refill pack is packaged in a sterile outer packaging, as this avoids contamination of the outer faces of the packaging of the refill pack and the corresponding collection of contaminants on the holder into which the refill pack is inserted.

According to an embodiment, a sterile refill pack is inserted into the holder. This is, for example, a blister pack.

The sterile outer packaging is preferably a sterile pouch made of plastics or a sterile plastics box.

Finally, the object is achieved by a method for producing a refill pack.

In the method according to the invention for producing a refill pack containing pipette tips a blister film made of plastics is inserted into a vacuum tool with a cavity with a bearing edge in the upper region, a blister pack adapted to the shape of the cavity is produced with an upper bearing edge, by the action of a vacuum and temperature on the blister film, a perforated plate filled with pipette tips is inserted into the blister pack or a perforated plate is inserted into the blister pack, and subsequently the perforated plate is filled with pipette tips and a cover is laminated on the upper bearing edge of the blister pack.

The method according to the invention is suitable for producing refill packs with exceptionally low material consumption. The pipette tips may, in particular, be stored in the sterile state in the refill pack, when the refill pack is manufactured under sterile conditions. The sterile conditions may be maintained until the refill pack is opened. The refill pack only needs to be opened in a holder, i.e. directly before removing pipette tips for the purpose of metering. The lamination takes place, for example, by heat sealing and/or heat welding a cover made of plastics to the blister pack made of plastics.

BRIEF DESCRIPTION OF THE SEVERAL VIEWS OF THE DRAWINGS

The invention is described in more detail hereinafter with reference to the accompanying drawings of exemplary embodiments, in which:

FIG. 2 shows the refill pack in a perspective view obliquely from above and from the side;

FIG. 3.1 shows the holder with the lid folded open in a perspective view obliquely from above and from the side;

FIG. 3.2 shows an alternative holder with feet, with the lid folded open in a perspective view obliquely from above and from the side;

FIG. 28 shows a tabular overview of the measured values of the stiffness of the container of a device according to the invention and the holder according to the invention as well as containers of conventional refill stacks and lower parts of conventional holders.

DETAILED DESCRIPTION OF THE INVENTION

Figure 1:
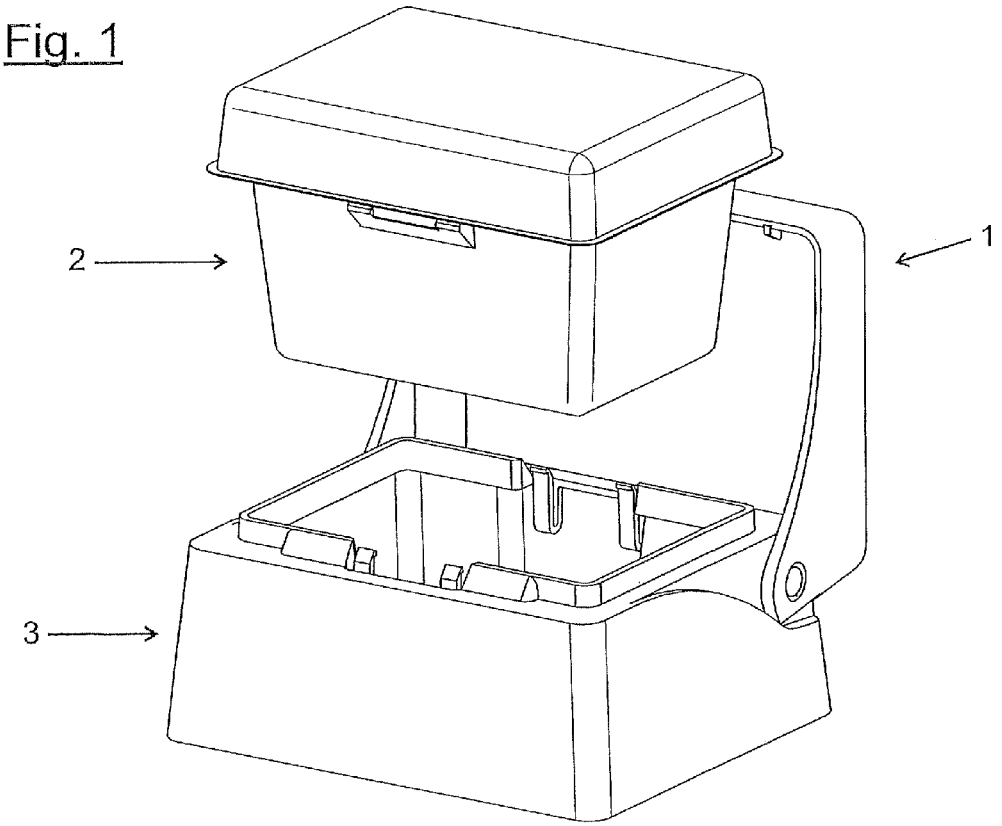
FIG. 1 shows a device for providing pipette tips when a refill pack is inserted in a holder in a perspective view obliquely from above and from the side.

While this invention may be embodied in many different forms, there are described in detail herein a specific preferred embodiment of the invention. This description is an exemplification of the principles of the invention and is not intended to limit the invention to the particular embodiment illustrated.

In this application, the terms "top" and "bottom" relate to an alignment of the device with a horizontal perforated plate, the container being arranged substantially below the perforated plate and the cover substantially above the perforated plate. Moreover, the receiver with its opening is aligned horizontally for inserting the refill pack and the lid is located vertically above the receiver of the lower part.

In various exemplary embodiments, the same or parts which correspond in principle are provided with the same reference numerals.

According to FIG. 1 the device 1 according to the invention comprises a refill pack 2 and a holder 3.

Figure 4:
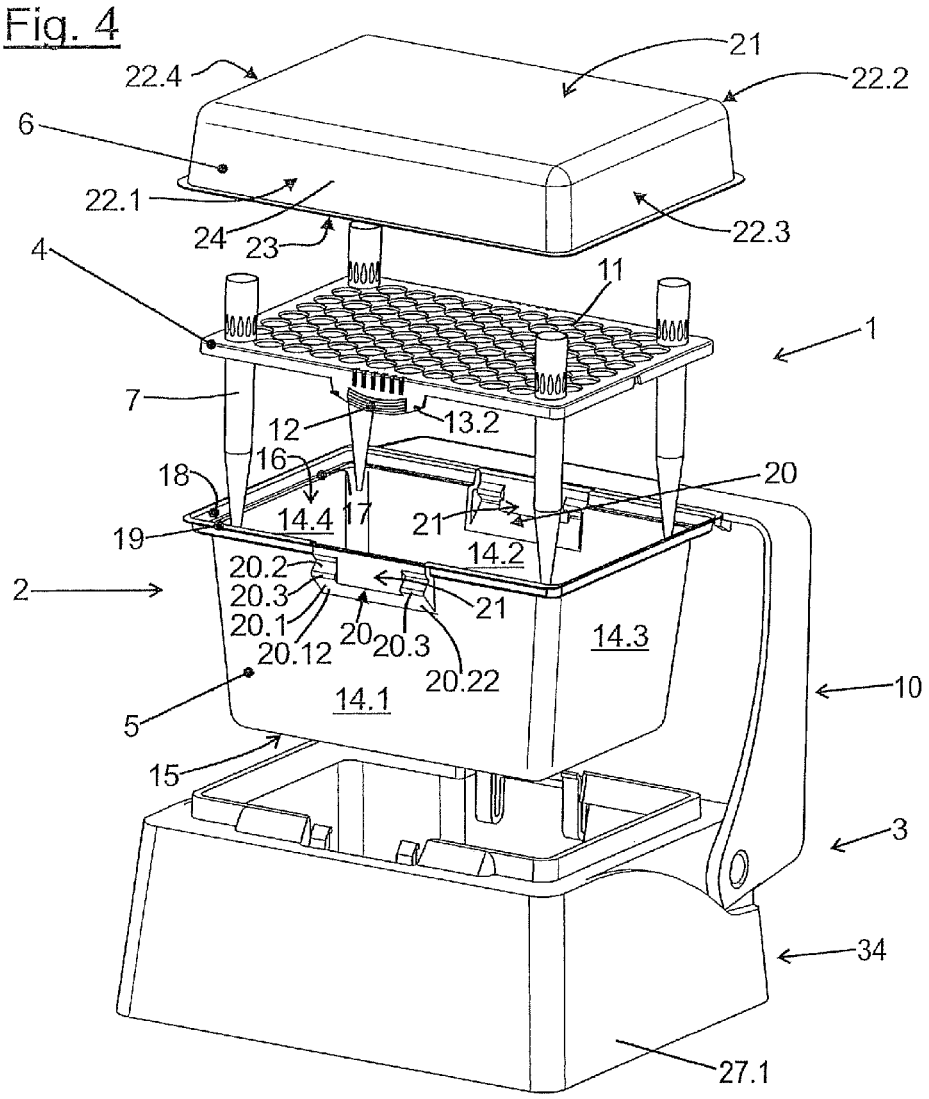
FIG. 4 shows the device in a perspective exploded view.

According to FIGS. 2 and 4, the refill pack 2 comprises a perforated plate 4, a container 5 arranged below said plate, and a cover 6 arranged above the perforated plate 4. Pipette tips 7 are inserted into the perforated plate, which in FIG. 4 is shown by way of example for four pipette tips 7.

According to FIGS. 3.1 and 4 the holder 3 comprises a frame 8, a trough 9 and a lid 10.

The perforated plate 4 is a substantially rectangular plate which comprises in 8 rows and 12 columns a total of 96 circular holes 11. The holes 11 are dimensioned so that pipette tips 7 of specific sizes may be inserted therein and are held in the perforated plate 4 without falling through the holes 11, due to a widening of their outer diameter toward the upper end. To this end, the pipette tips 7 may have a diameter which widens continuously from the lower end to the upper end or may have a sudden increase in the external diameter.

Latching tabs 12 protrude downwards from the two longer edges of the perforated plate 4. The latching tabs 12 are arranged approximately in the middle of the two longer edges. The latching tabs 12 in each case have latching lugs 13.1, 13.2, in addition to their two lateral edges.

The perforated plate 4 is produced from a resilient plastics material, so that the latching tabs 12 and/or the latching lugs 13.1, 13.2 are elastically deformable. The perforated plate 4 is preferably produced by injection-moulding.

The container 5 is substantially box-shaped. In the exemplary embodiment, the distance between the opposing side walls 14.1, 14.2 and/or 14.3, 14.4 increases slightly from the bottom 15 to an upper opening 16 of the container 5. The container 5 has an externally protruding projection 17 circulating on the upper edge. A vertical upper edge portion 18 is adjoined thereto. A horizontally outwardly protruding upper bearing edge 19 is arranged on the upper end of the upper edge portion.

Approximately centrally in the two side walls 14.1, 14.2 is located in each case directly below the projection 17 a recess 20 of the side walls 14.1, 14.2 which in the vertical section of FIG. 6 has two portions 20.1, 20.2 oriented at acute angles to the plane of the side walls 14.1, 14.2, said portions being connected together along a connecting line 20.3. According to FIG. 4, the side walls 14.1, 14.2 have recesses 21 below the upper bearing edge 19 between two strip-shaped edge portions 20.12, 20.22 of the shaped portions 20, said recesses extending approximately as far as the connecting line 20.3 and/or a short distance below.

The container 5 is preferably produced by deep-drawing from a thin plastics film.

According to FIGS. 2 and 4, the cover 6 is configured in the manner of a hood, proceeding from the base 21 of the cover 6, the distance from the opposing side walls 22.1, 22.2, 22.3, 22.4 of the cover 6 widening toward the opening 23 of the cover 6. The cover 6 according to FIG. 4 has linear or punctiform latching projections 24 on the inner faces of its side walls 22.1 to 22.4, said latching projections being able to be latched to the upper bearing edge 19 (see FIG. 6).

The perforated plate 4 is able to be positioned on the upper bearing edge 19 of the container 5. In this case, the latching tabs 12 engage in the recesses 21 and the latching lugs 13.1, 13.2 are latched behind the strip-shaped edge portions 20.12, 20.22 of the shaped portions 20 (see FIG. 2). Through the recesses 21, the latching tabs 12 may be forced inwards, so that the latching lugs 13.1, 13.2 are released from the shaped portions 20 and the perforated plate 4 is able to be lifted away from the container 5.

According to FIG. 2, the perforated plate 4 is positioned on the container 5 and by the cooperation of the latching lugs 13.1, 13.2 and shaped portions 20 latched therewith. Moreover, the cover 6 is latched on its latching projections 24 to the upper bearing edge 19 of the container 5. In this state, the refill pack 2 is able to be inserted into the holder 3, the pipette tips 7 being protected against contamination.

According to FIGS. 3.1 and 4 the frame 8 of the holder 3 comprises an upper, substantially horizontal frame part 25 which encloses a receiver 26 of the holder 3 at the top. The upper frame part 25 is connected at the bottom to the trough 9. The trough 29 protrudes downwards from an inner edge of the upper frame part 25. From the outer edge of the upper frame part 25, a circumferential apron 27.1 protrudes downwards, which encloses the trough 9. The apron 27.1 protrudes the same distance or slightly further downwards from the upper frame part 25 than the trough 9.

In the variant of FIG. 3.2 four feet 27.2 protrude downwards from the corners of the upper frame part 25. The four feet 27.2 protrude downwards the same distance or slightly further than the trough 9.

The trough 9 is substantially cuboidal. In the example of FIGS. 3.1 and 3.2 it has opposing side walls 28.1, 28.2, 28.3, 28.4, the distance thereof from the base 29 to the upper opening 30 of the receiver 26 being slightly increased. The trough 9 and the upper frame part 25 border the receiver 26 of the holder 3 which is accessible from the top through the opening 30.

The lower bearing edge 31 of the holder 3 extends around the opening 30.

Figure 6:
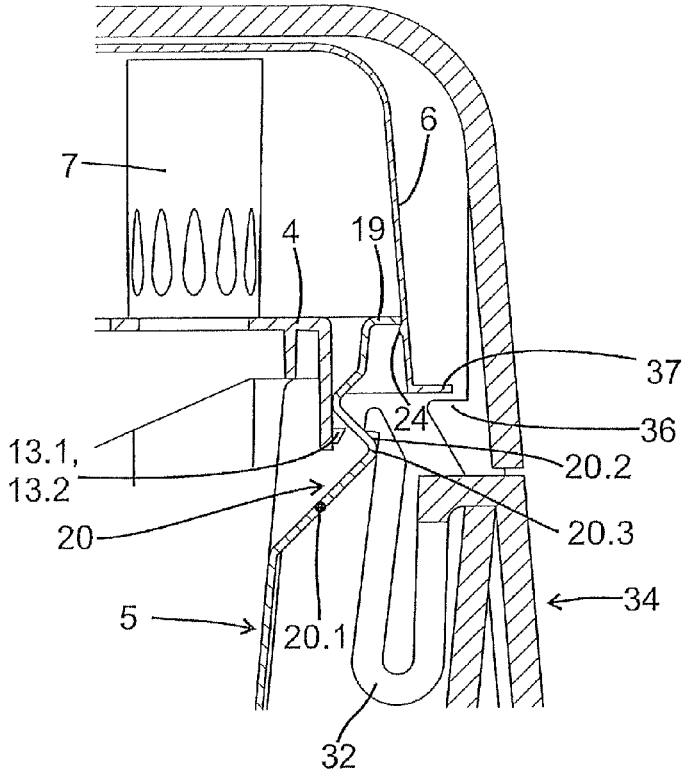
FIG. 6 shows the latching of the perforated plate, container and holder of the same device in a partial vertical section.
Figure 7:
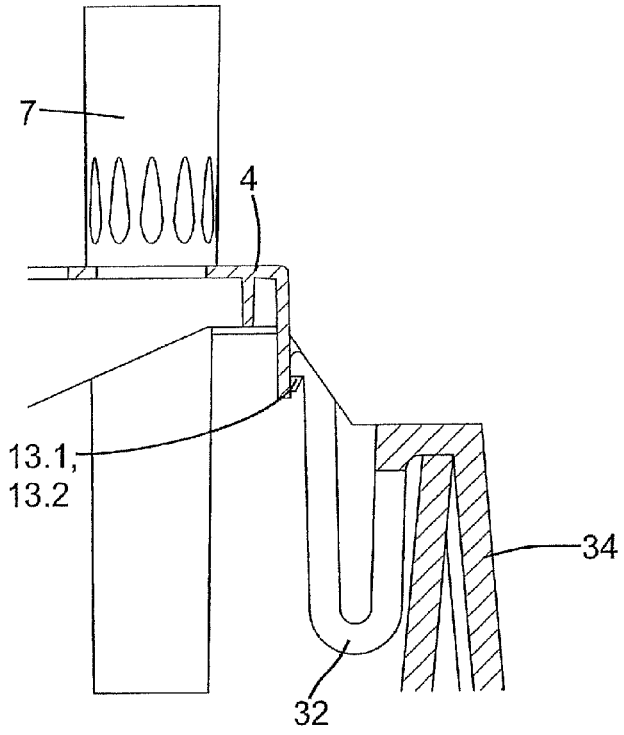
FIG. 7 shows the latching of a perforated plate with the holder of the same device in a partial vertical section.

The upper frame part 25 has on the inner edges of its two long sides in each case two latching hooks 32 which in the vertical section of FIGS. 6 and 7 are U-shaped. The distance of the latching hooks 32 from one another corresponds to the distance between the strip-shaped edge portions 20.12, 20.22 of the shaped portions 20 of the container 5. Between the two latching hooks 32, on the upper edge of the upper frame part 25 free spaces 33 are present which permit access to the latching tabs 12 of a perforated plate 4.

Figure 5:
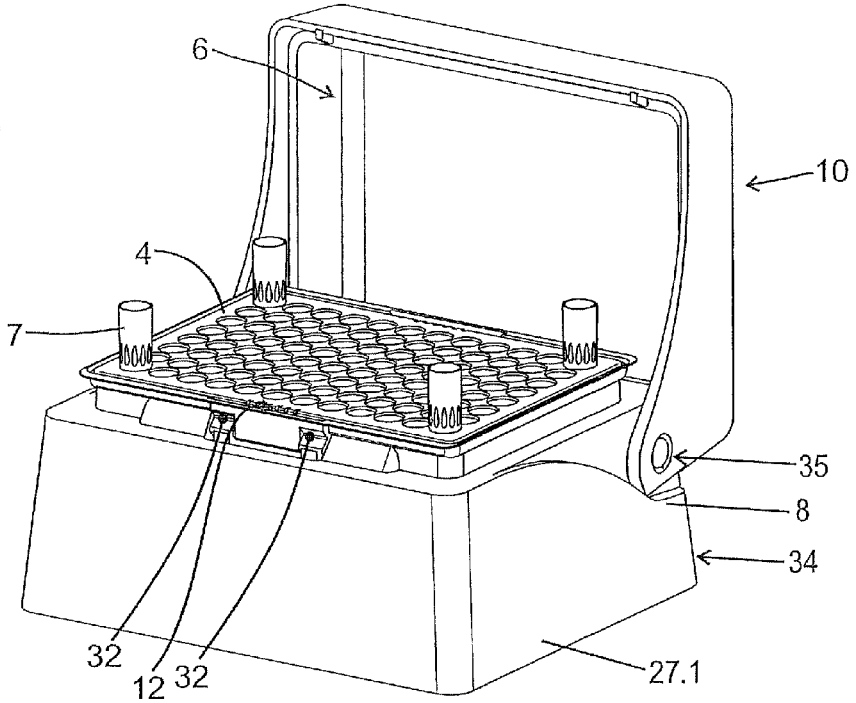
FIG. 5 shows the device with the refill pack inserted into the holder with the lid opened and the cover removed in a perspective view obliquely from above and from the side.

According to FIGS. 5 and 6, the latching hooks 32 engage around the outer faces of the shaped portions 20 when the refill pack 2 is inserted into the holder 3. According to FIG. 7 the latching hooks 32 engage over the latching lugs 13.1, 13.2 on the latching tabs 12 when the perforated plate 4 is latched in the holder 3 without the container 5.

The trough 9 and the frame 8 are, for example, injection-moulded separately and connected together, for example by latching, or produced in one piece in a two-component injection-moulding method. They form together the lower part 34 of the holder 3.

The lid 10 is articulated via articulated connections 35 to an outer edge of the horizontal frame part 25. The cover 6 and the lid 10 in each case comprise complementary undercuts 36, 37 (see FIGS. 6, 7) which engage behind one another when the refill pack 2 is inserted into the holder 3 and the lid 10 is folded down.

The latching between the lid 10 and the cover 6 is stronger than the latching between the cover 6 and the container 5, so that the cover 6 is lifted away from the container 5 when the lid 10 is opened. In this case, the cover 6 remains in the lid 10. This situation is shown in FIG. 5. Preferably, the latching between the refill pack 2 and the holder 3 is greater than the latching between the cover 6 and the container 5, so that the refill pack 2 is not pulled out of the holder 3 when the lid 10 and the cover 6 are opened. The pipette tips 7 are then ready to be received by a pipette. By closing the lid 10, the cover 6 is again latched to the container 5 and the remaining pipette tips 7 protected from contamination.

If all pipette tips 7 are removed from the refill pack 2, said refill pack may be pulled out of its latched portions and replaced by a new refill pack 2. Optionally, the perforated plate 4 may be initially removed from the container 5, whereby the lifting of the further latched portions is simplified. The parts of the refill pack 2 may be disposed of in a space-saving manner.

Figure 8:
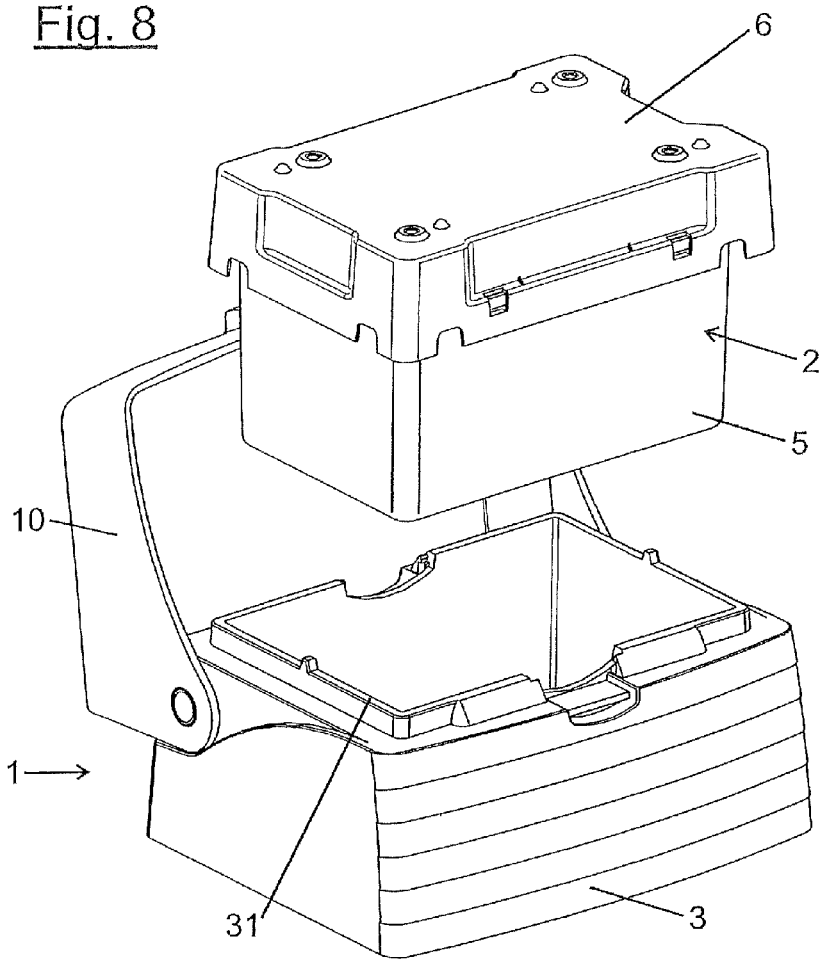
FIG. 8 shows a further exemplary embodiment of a device for providing pipette tips when inserting the refill pack in the holder in a perspective view obliquely from above and from the side.
Figure 9:
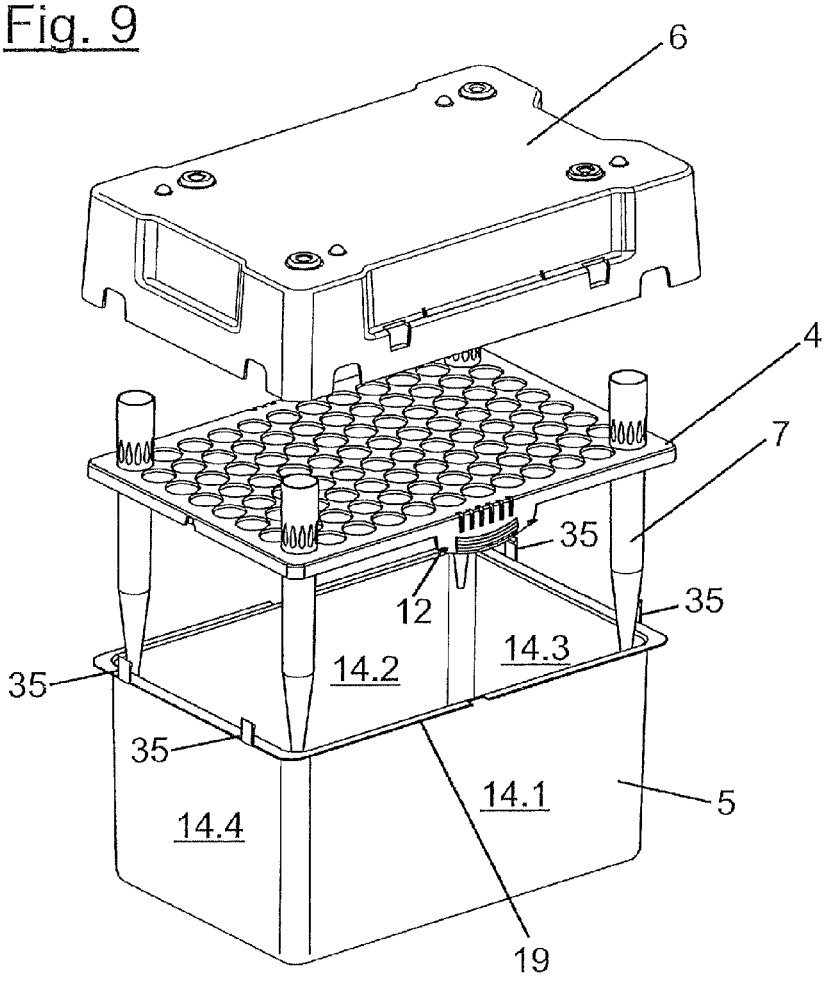
FIG. 9 shows the refill pack of said device in a perspective exploded view obliquely from above and from the side.
Figure 10:
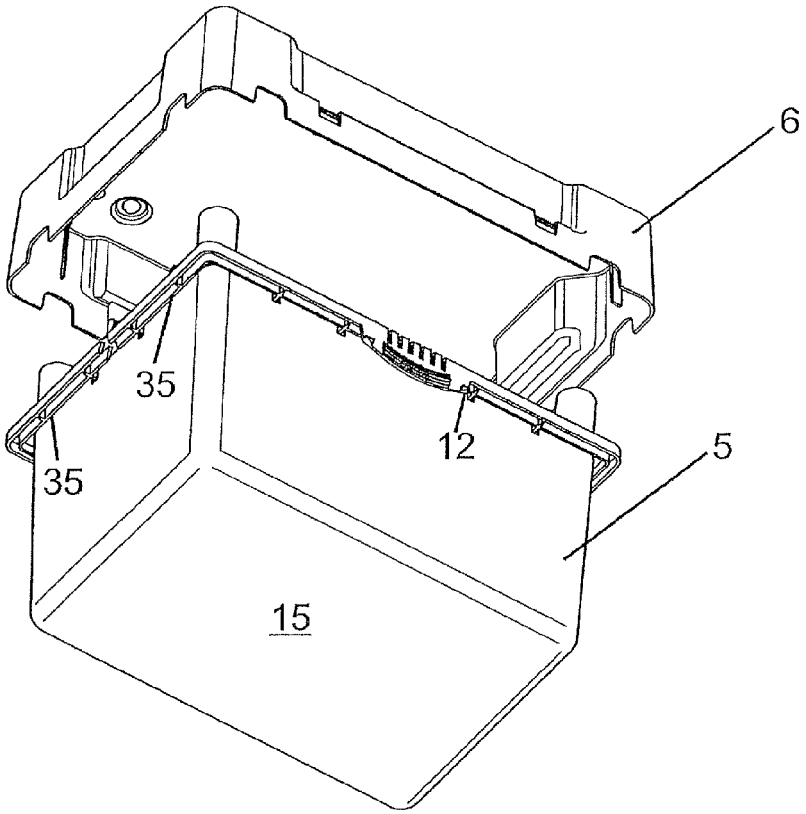
FIG. 10 shows the refill pack with the lid removed in a perspective view obliquely from below and from the side.

The exemplary embodiment of FIGS. 8 to 11 differs from that described above, in particular, by the upper bearing edge 19 of the container 5 being directly connected to the side walls 14.1 to 14.4. Moreover, snap hooks 35 protrude from the outer edges of the narrow sides of the upper bearing edge 19. The container 5 is able to be locked via the snap hooks 35 to the perforated plate 4 (see FIGS. 10 and 11). In this case, the latching tabs 12 are arranged on the outer faces of the side walls 14.1, 14.2. The container 5 is thus fastened by means of a snap connection below the perforated plate 4. The cover 6 is able to be positioned from the top onto the perforated plate 4, so that it is connected by a non-positive connection therewith, as shown in FIG. 8.

Figure 11:
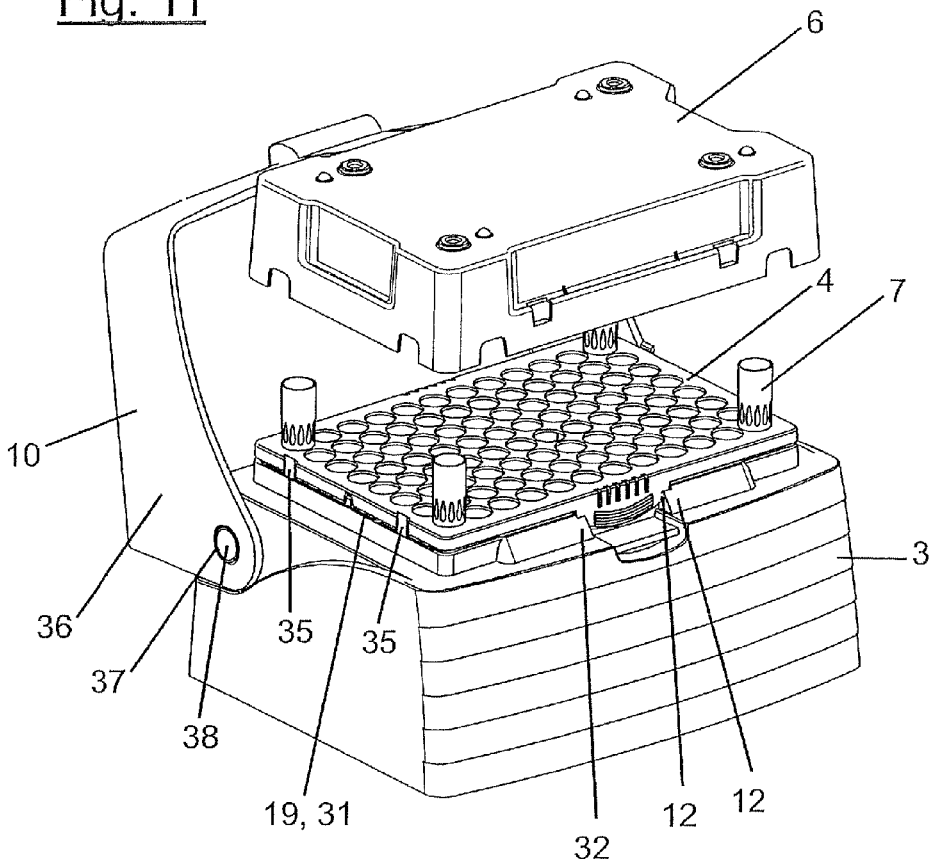
FIG. 11 shows the device with the refill pack inserted into the holder and the cover removed in a perspective view obliquely from above and from the side.

If said refill pack 2 according to FIG. 11 is inserted into the holder 3, the latching lugs 13.1, 13.2 of the perforated plate 4 are directly locked with the latching hooks 32 of the holder 3. In this case, the perforated plate 4 is supported via the upper bearing edge 19 on the lower bearing edge 31 of the holder 3.

The lid 10 of the holder 3 is mounted via lateral plates 36 with bearing eyes 37 on bearing pins 38, which protrude outwardly from side walls of the holder 3. The cover 6 must specifically be removed from the refill pack 2 in order to have access to the pipette tips 7. After removal of the pipette tips the refill pack 2 may be protected by closing the lid 10.

In this exemplary embodiment, a conventional perforated plate 4 and a conventional cover 6 are used.

Figure 12:
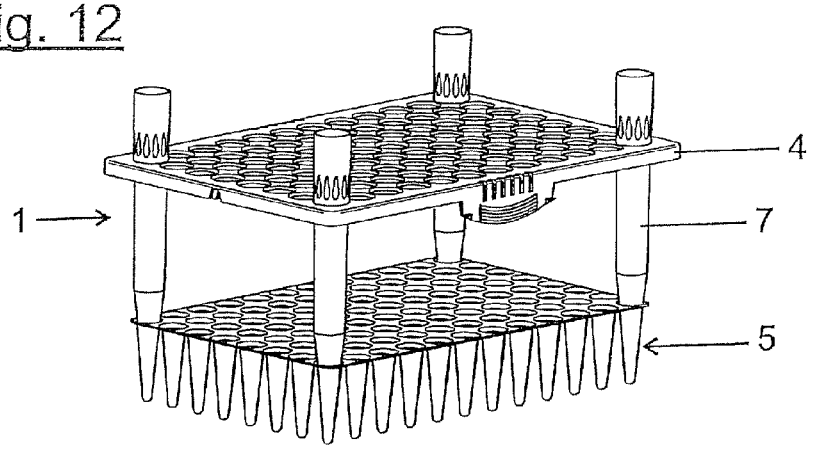
FIG. 12 show the perforated plate with the pipette tips inserted and the container of a variant of the refill pack in a perspective view obliquely from above and from the side.
Figure 13:
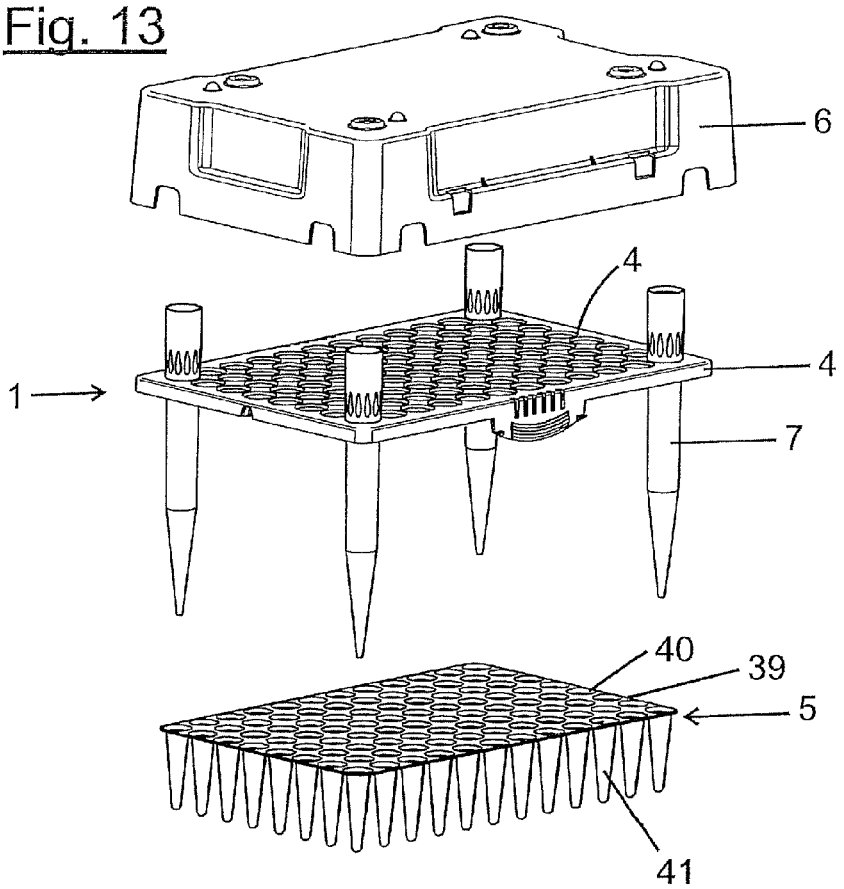
FIG. 13 shows the same variant with the associated cover exploded in a perspective view obliquely from above and from the side.

The refill pack 2 of FIGS. 12 and 13 differs from the refill pack 2 according to FIGS. 8 to 11 in that the container 5 merely covers the lower regions of the pipette tips 7. To this end, the container 5 is configured as a base plate. Said base plate has a plate-shaped carrier 39 with a plurality of circular plate holes 40, hollow cone-shaped portions 41 protruding from the underside thereof. The arrangement of the plate holes 40 corresponds exactly to the arrangement of the holes in the perforated plate 4. The internal contour of the hollow cone-shaped portions 41 is adapted to the outer contour of the lower conical regions of the pipette tips 7.

The pipette tips held in the perforated plate are able to be inserted through the plate holes 40 into the hollow cone-shaped portions 41, and by pressing-in are able to be non-positively connected therewith. In this arrangement, the refill pack 2 is shown in FIG. 12.

The container 5 configured as a base plate protects the lower parts of the pipette tips when moving the refill pack 2 into a holder 3 according to FIG. 8. When moved, preferably a cover 6 corresponding to FIG. 8 is additionally pushed onto the perforated plate 4, in order to protect the pipette tips 7 from the top. Thus the regions of the pipette tips 7 coming into contact with gas and/or fluid are protected when moved. Said refill pack 2 is particularly economical in terms of material consumption.

Figure 14:
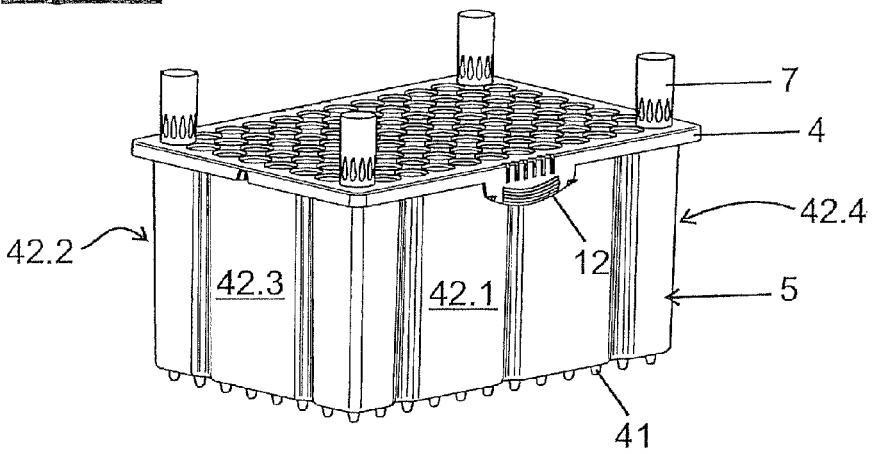
FIG. 14 shows a further variant of a perforated plate with pipette tips and container in a perspective view obliquely from above and from the side.
Figure 15:
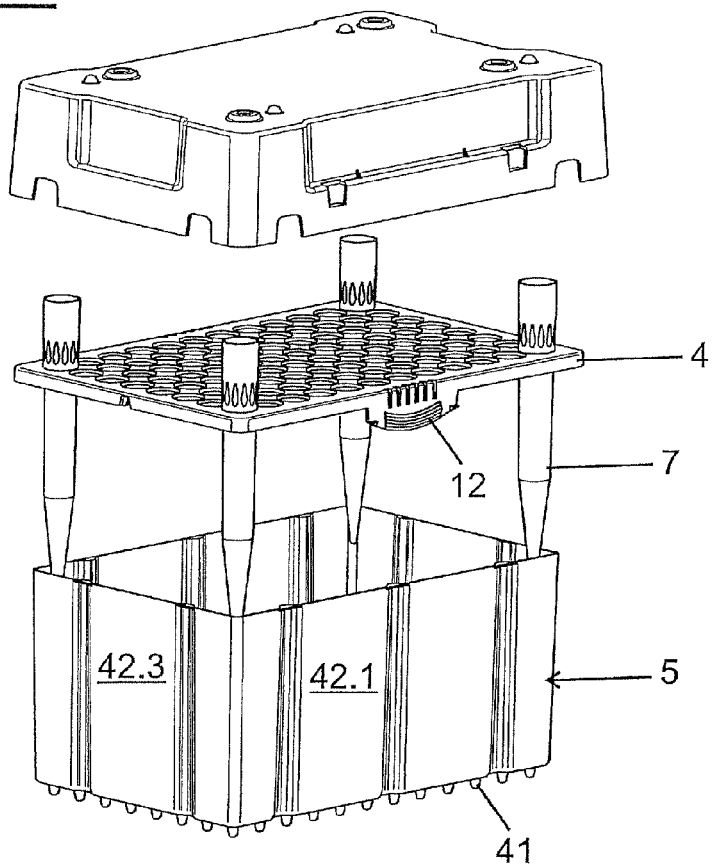
FIG. 15 shows the same variant with the associated cover in an exploded perspective view obliquely from above and from the side.

The refill pack 2 of FIGS. 14 and 15 differs from that above in that the container 5 which is configured as a base plate is additionally provided with raised side walls 42.1 to 42.4 which cover the pipette tips 7 at the side. If the perforated plate 4 sits on the upper edge of the side walls 42.1 to 42.4 and the pipette tips 7 are pressed into the hollow cone-shaped portions 41, the arrangement consisting of the pipette tips 7, perforated plate 4 and container 5 is held non-positively and positively. Additionally, the cover 6 is fixed by being pressed non-positively on the perforated plate 4.

The refill packs 2 of FIGS. 12 to 15 are, in principle, able to be inserted into a holder 3 and able to be removed therefrom, as is the refill pack 2 of FIGS. 8 to 11.

Figure 16:
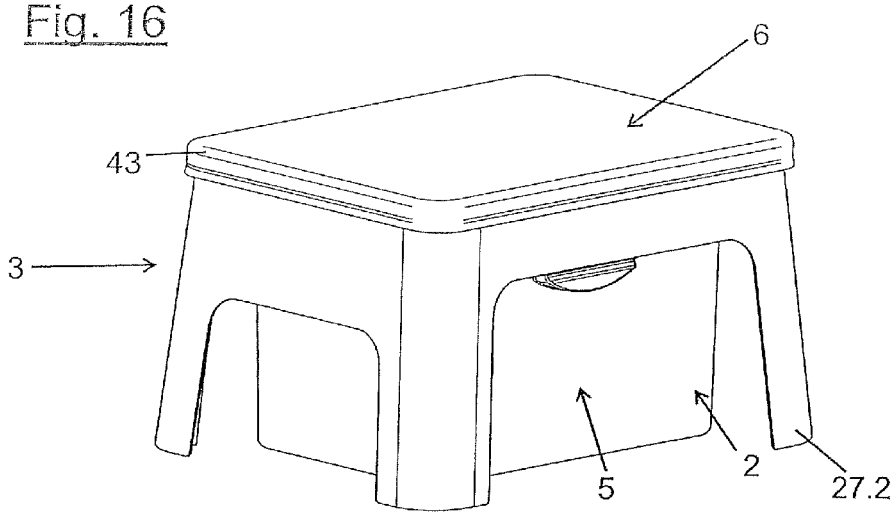
FIG. 16 shows a further device for providing pipette tips in a perspective view obliquely from above and from the side.
Figure 17:
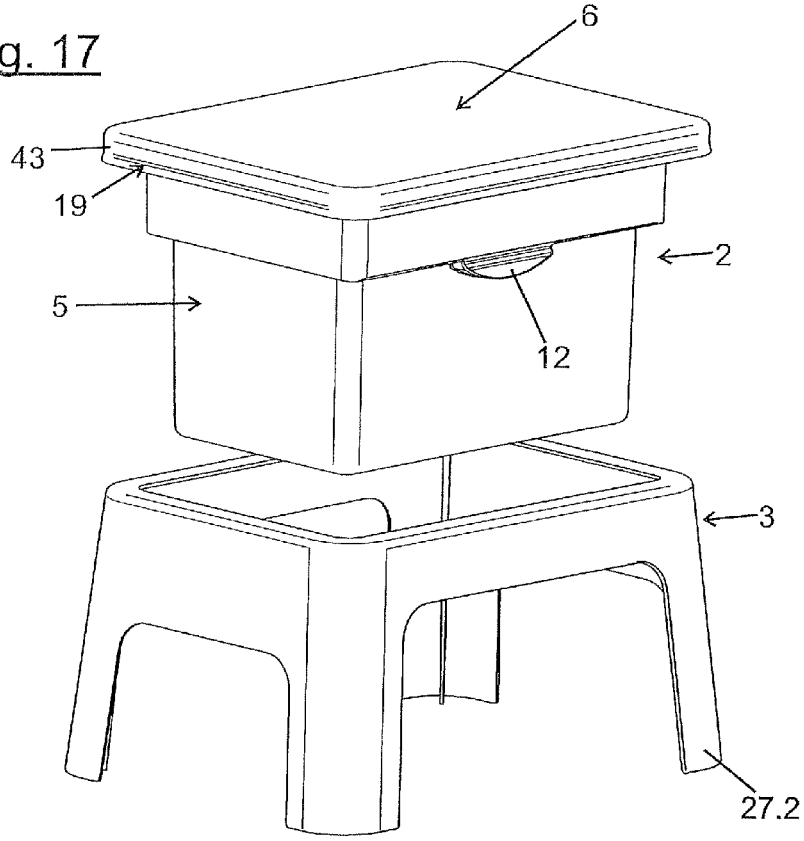
FIG. 17 shows the same device when inserting the refill pack in a perspective view obliquely from above and from the side.
Figure 18:
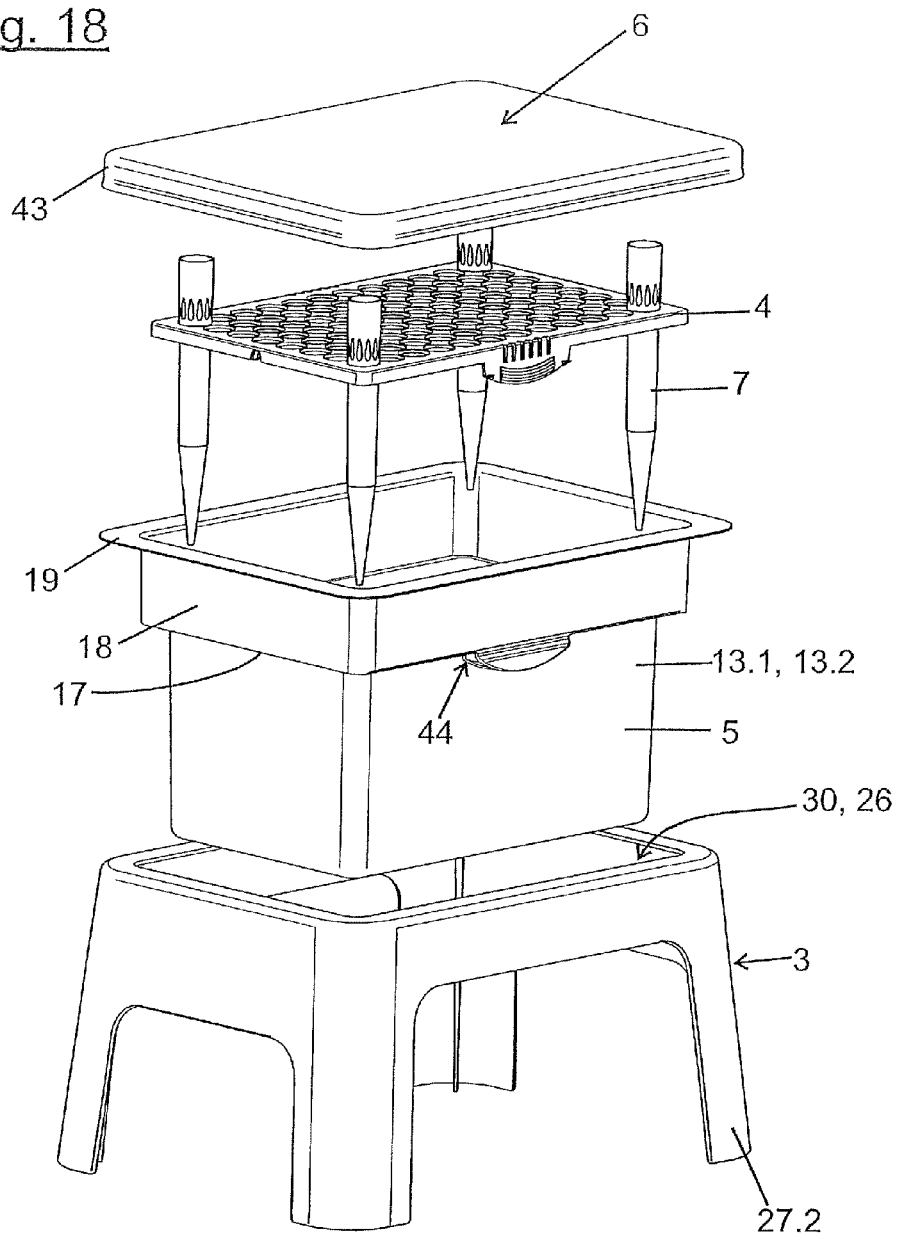
FIG. 18 shows the same device in an exploded perspective view obliquely from above and from the side.

The exemplary embodiment of FIGS. 16 to 18 differs from the exemplary embodiment of FIGS. 1 to 7, in particular in that the holder 3 is configured without the trough 9 and without the lid 10. Moreover, the cover 6 of the refill pack 2 is configured as a snap lid, which may be snapped shut with the outer edge of the upper bearing edge 19 of the container 5. As the snap edge 43 of the cover 6 engages around the outer edge of the bearing edge 19, the snap edge 43 itself bears on the lower bearing edge 31, as shown in FIG. 16.

The perforated plate 4 bears on the outwardly protruding projection 17 of the container 5 and the latching tabs 12 penetrate slots 44 of the projection 17 so that they are accessible from outside below the projection 17. The latching tabs 12 are thus able to be locked on suitable latching lugs 13.1, 13.2 with corresponding undercuts of the holder 3.

In this device, the pipette tips 7 are merely protected from contaminants by the container 5 and the cover 6.

Figure 19:
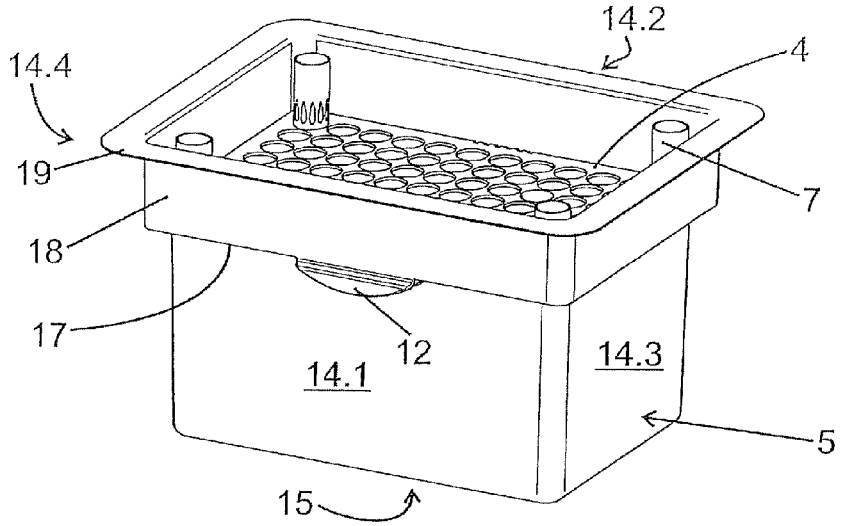
FIG. 19 shows a further variant of a refill pack with a container designed as a blister pack with the inserted perforated plate in a perspective view obliquely from above and from the side.

In the exemplary embodiment of FIG. 19, the container 5 is configured according to the container of the refill pack 2 of FIGS. 14 to 18. The container 5 is produced as a blister pack. In this exemplary embodiment, the cover 6 may also be formed by a film laminated onto the upper bearing edge 19.

Figure 20:
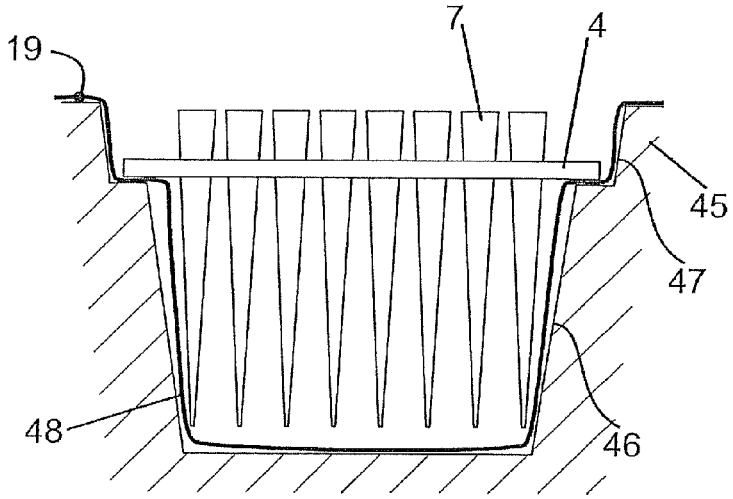
FIG. 20 shows the production of the blister pack in a vacuum tool in a rough schematic vertical section.
Figure 21:
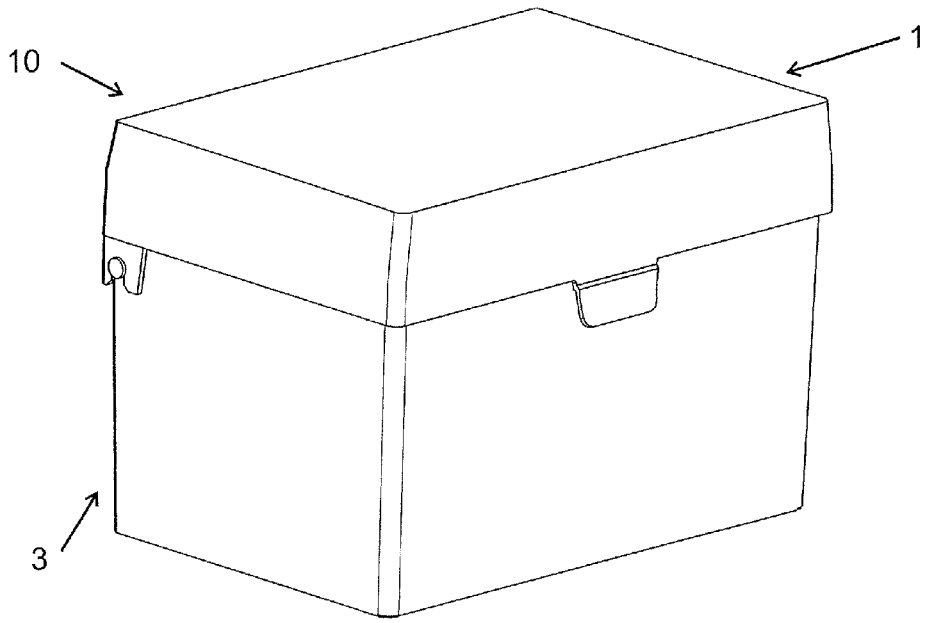
FIG. 21 shows a further device for providing pipette tips in a perspective view obliquely from above and from the side.
Figure 22:
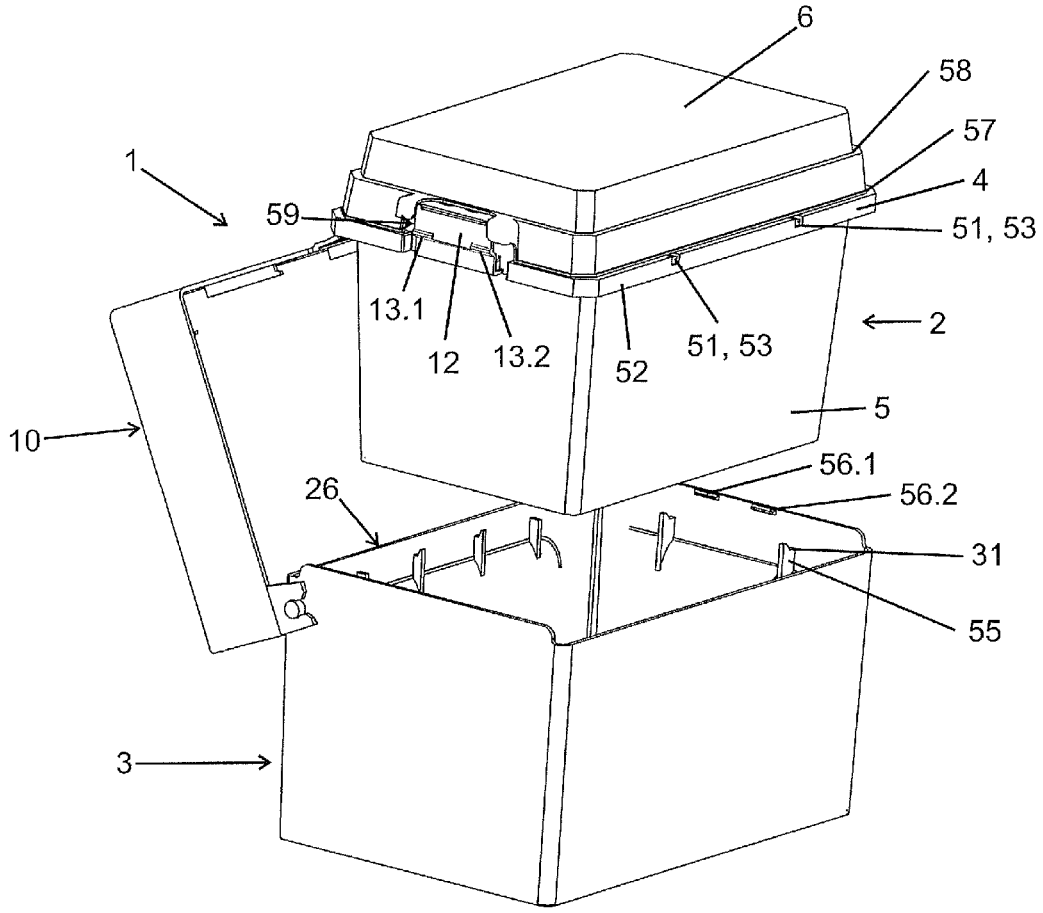
FIG. 22 shows the same device when inserting the refill pack in a perspective view obliquely from above and from the side.
Figure 23:
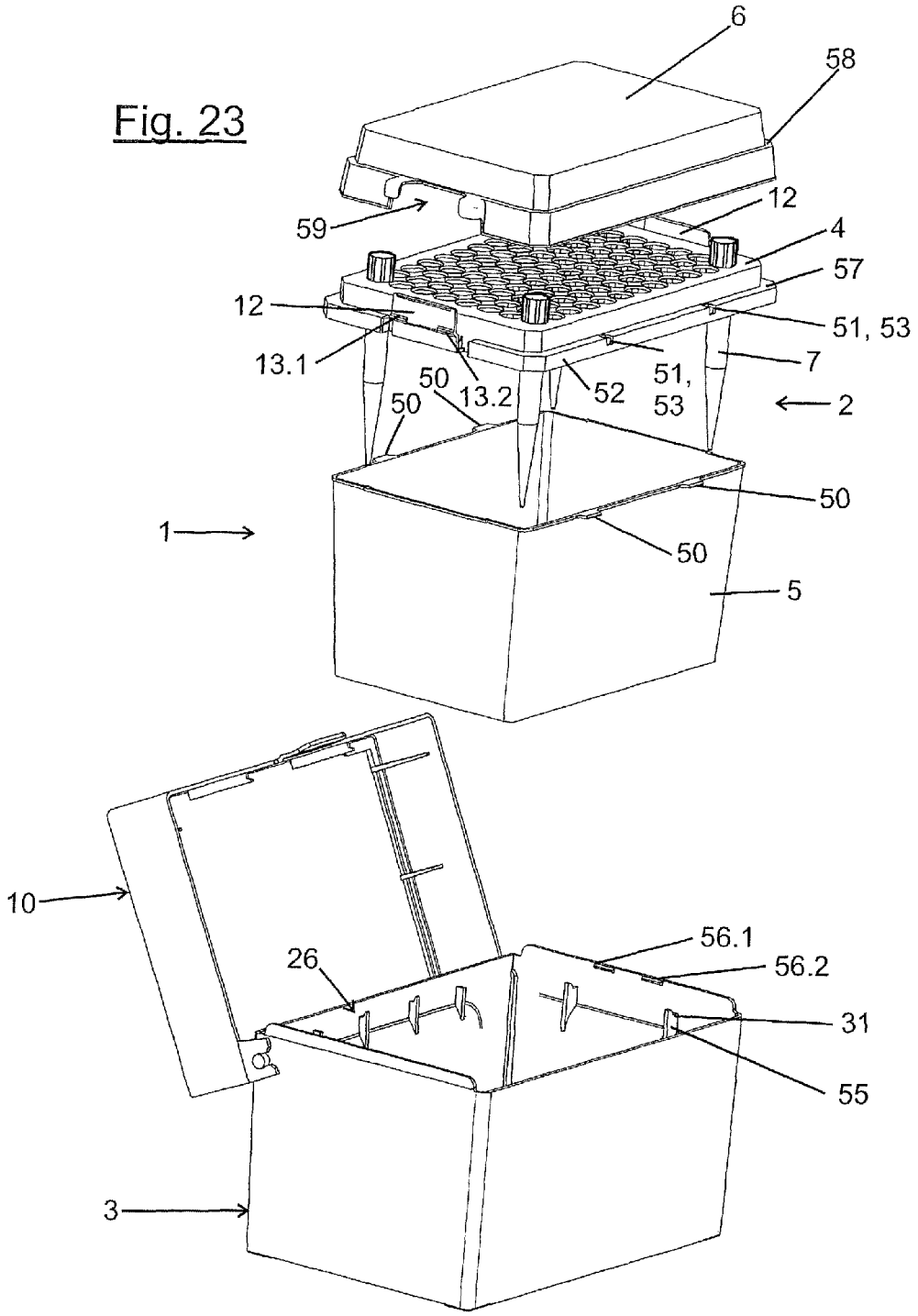
FIG. 23 shows the same device in a perspective exploded view obliquely from above and from the side.
Figure 24:
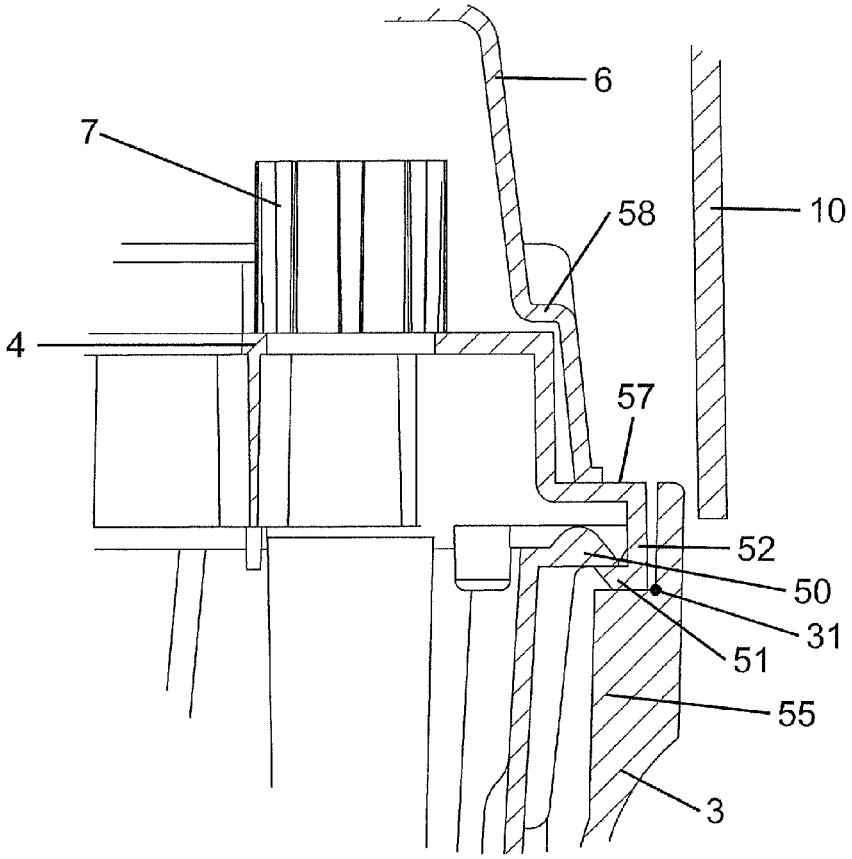
FIG. 24 shows the latching of the perforated plate and container of said device in a partial vertical section.
Figure 25:
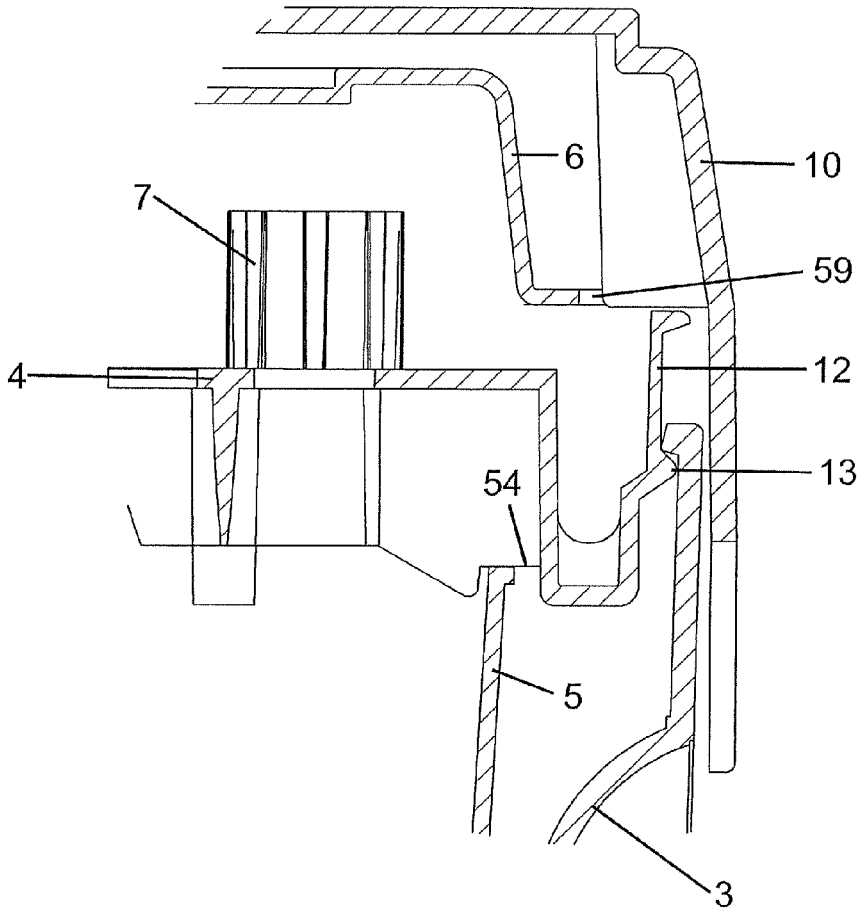
FIG. 25 shows the latching of the perforated plate and holder of said device in a partial vertical section perpendicular to the section of FIG. 24.

According to FIG. 20, a blister film 48 made of plastics is introduced in a vacuum tool 45 with a corresponding cavity 46 with a bearing edge 47 in the upper region. The blister pack 49 is then produced in the known manner by the action of a vacuum and temperature on the blister film 48. The refill pack 2 is then produced by a perforated plate 4 filled with pipette tips 7 being inserted into the blister pack 49. Finally, a cover 6 made of paper or a suitable film may be laminated onto the upper bearing edge 19 of the blister pack 49. The pipette tips 7 may optionally also be inserted into the perforated plate 4 after forming the blister pack 49.

This mode of production is able to be automated and is easily implemented in terms of process technology. The blister pack permits a considerable reduction in packaging waste. Moreover, a refill pack 2 designed as a blister pack 49 permits the filling of a holder 3 with sterile pipette tips 7. The cover 6 and/or the laminated film only need to be removed shortly before the removal of the pipette tips 7.

The refill pack 2 with a blister pack as a container 5 may be latched in the holder 2, the latching tabs 12 being able to be locked with the latching lugs 13.1, 13.2 through the blister pack 48, with the corresponding latching hooks 32 or other undercuts of the holder 3. When the refill pack is latched, the sealing film may be removed from the blister pack 49 and the pipette tips 7 may be removed. The blister film 48 is sufficiently flexible that it does not interfere with the bearing of the perforated plate 4 in a planar manner on the lower bearing edge 31, so that even the pipette tips 7 on the edge may be removed in an unimpeded manner.

The exemplary embodiment of FIGS. 21 to 25 has the peculiarity that the container 5 is connected to the underside of the perforated plate 4. To this end, the container 5 comprises outwardly protruding latching tabs 50 on the two longer upper edges. The latching tabs 50 are able to be latched to latching projections 51 of the perforated plate 4, which protrude inwardly below openings 53 from an edge region 52 of the perforated plate 4, said edge region protruding in the manner of an apron to the side and downwards. In the latched position of the perforated plate 4 and container 5, the container 5 is additionally supported with its upper edge on downwardly protruding ribs 54 on the underside of the perforated plate 4. The perforated plate 4 latched to the container 5 is able to be positioned with its edge region 52 protruding to the side and downwards on a lower bearing edge 31 of the holder 3, which is formed by the upper edge of inwardly protruding bearing ribs 55 on the inside of the holder 3.

Moreover, the perforated plate 4 comprises upwardly protruding latching tabs 12 on the narrow edges, which are able to be latched via latching lugs 13.1, 13.2 on their outer face with latching beads 56.1, 56.2 inside on the edge of the opening 30 of the holder 3.

Moreover, said device 1 has a peripheral step 57 above the edge region 52 of the perforated plate 4. A shell-shaped cover 6 is loosely positioned on the step 57. To this end, the cover 6 also has a peripheral outer step 58 on the lower edge. In the region of the outer step 58, the cover is provided with recesses 59 on the narrow sides, through which the latching tabs 12 are accessible from the outside.

The refill packs 2 of said exemplary embodiment are able to be inserted easily with the cover 6 in position into the holder 3, so that the lower edge of the perforated plate 4 is positioned on the bearing ribs 55. In this case, the latching tabs 12 are engaged behind the latching beads 56.1, 56.2. In this arrangement, the lid 10 of the holder 3 is pivoted down. For removing the pipette tips 7, the lid 10 is pivoted up and the cover 6 removed. Then the pipette tips 7 are able to be removed from the refill pack 2.

When the pipette tips 7 have been used, the empty refill pack 2 may be removed from the holder 3 by releasing the latching tabs 12, with or without the cover 6 in position.

Figure 26:
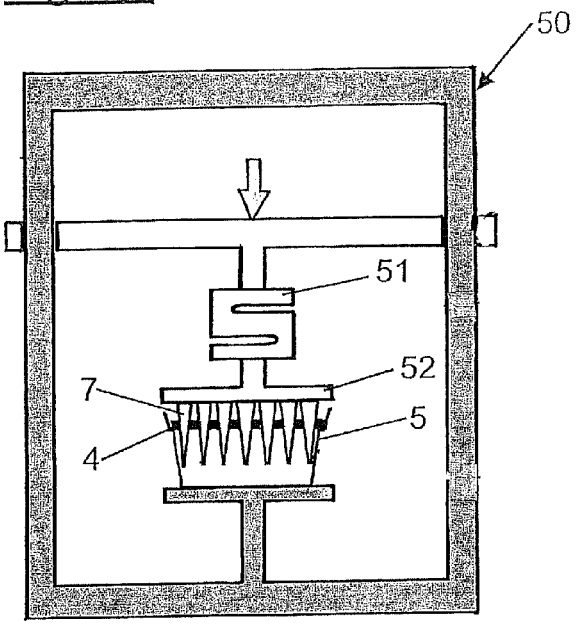
FIG. 26 shows the arrangement for determining the dependency of the deformation of the containers and holders on the applied compressive force in a rough schematic view.

According to FIG. 26, for determining the stiffness of a container 5, a test structure is used, in which a pressure testing machine 60 of the Zwick/Roell Z005 type is used, year of construction 2003. The compressive force exerted by the pressure testing machine 60 and the deformation are measured by a force and path measuring device 61. The force is introduced via a metal plate 62 at the top into the pipette tips 7 which sit in the perforated plate 4, in order to minimise the influence of the bending of the perforated plate 4. From the perforated plate 4, the compressive force is transmitted to the upper edge of the container 5.

Figure 27:
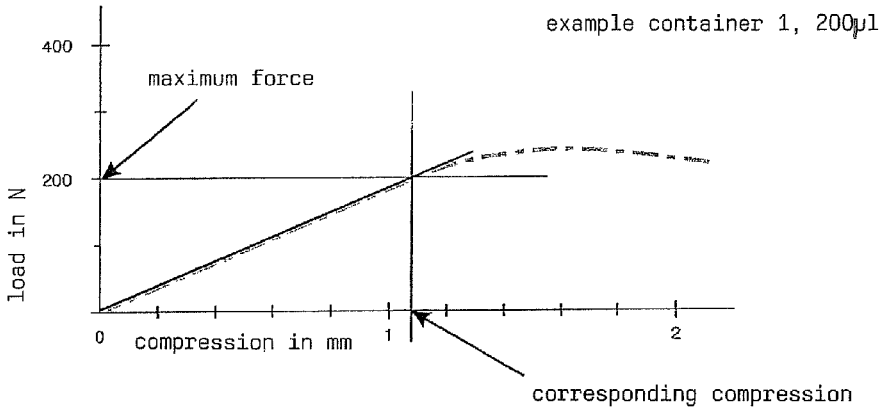
FIG. 27 shows a diagram with the measured force-path-curves of the container of a conventional refill pack and the lower part of a conventional holder.

The respectively tested container 5 is loaded with pressure up to a maximum of 1000 Newtons and/or 5 mm compression. The Zwick pressure measuring device records the force-path curves. In FIG. 27, said force-path curve is illustrated for an example of a container. The compressive force is provided in Newtons (N) and the compression in millimeters. The container 5 is deformed in a linear manner up to the maximum force. The stiffness is the quotient consisting of the maximum force (for example 200 N) and associated compression (for example 1.38 mm) In the example, the stiffness is 155 N/mm.

The value at which the products visibly deform in a non-linear and permanent manner is derived from the curves as the maximum force. The determination of the maximum force for the container of a conventional refill stack is plotted in FIG. 27.

The quotient of the maximum force and associated compression is calculated as the stiffness of the respectively tested container. The corresponding measured results of conventional containers and holders from different manufacturers and an exemplary embodiment of the container 5 according to the invention and the holder 3 according to the invention (manufacturer F, container 3) are provided in the overview of FIG. 28.

The containers of refill packs are shown to have a significantly lower stiffness than holders which are designed as a box or frame.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. Device for providing pipette tips comprising:

a refill pack (2) which includes:

a perforated plate (4) with a plurality of holes (11), a plurality of pipette tips (7), each inserted into one of the plurality of holes (11), a container (5) containing the plurality of pipette tips (7), the container (5) having a stiffness of up to 300 N/mm, and a removable cover (6) covering the plurality of pipette tips (7);

a holder (3) with a receiver (26) for receiving the refill pack (2), means for supporting (19, 31) the refill pack (2) when said refill pack is inserted into the receiver (26); and a first means for latching (12, 13.1, 13.2, 20, 32) the perforated plate (4) and holder (3) when the refill pack (2) is arranged in the receiver (26).

2. The device according to claim 1, in which the container (5) has a stiffness of up to 200 N/mm.

3. The device according to claim 1, in which the container (5) has a stiffness of at least 20 N/mm.

4. The device according to claim 1, further comprising a second means for latching (19, 24) the cover (6) and container (5) in a closed position of the cover (6) to the container (5).

5. The device according to claim 1, in which the means for supporting the refill pack comprise a laterally protruding upper bearing edge (19) of the container (5), on which the perforated plate (4) is supported, and a lower bearing edge (31) of the holder (3) protruding from an upper edge of the receiver (26) of the holder (3), on which the container (5) may be positioned with the container upper bearing edge (19); or the means for supporting the refill pack comprise a laterally protruding edge of the perforated plate (4), the container (5) being connected to an underside of the perforated plate (4), and a lower bearing edge (31) of the holder (3) that protrudes from the upper edge of the receiver (26) and onto which the perforated plate (4) may be positioned.

6. The device according to claim 1, in which latching the first means for latching (12, 13.1, 13.2, 20, 32) the perforated plate (4) and holder (3) requires a greater force than a force for latching a second means for latching (19, 24) the cover (6) and container (5).

7. The device according to claim 1, in which the holder further includes a lower part (34) and wherein the holder further includes a lid (10) covering the receiver (26) with an inserted refill pack (2).

8. The device according to claim 7, in which the lid (10) comprises an articulated connection (35) to the lower part (34).

9. The device according to claim 7, in which the lid (10) of the holder (3) and the removable cover (6) of the refill pack (2) comprise a third means for latching (36, 37) the lid (10) to the cover (6), which may be latched together by closing the lid (10) when the refill pack (2) is inserted into the receiver (26), the force for releasing the third means for latching between the lid (10) and the cover (6) by opening the lid (10) being greater than the force for releasing the second means for latching between the cover (6) and the container (5) by opening the cover (6).

10. The device according to claim 1, in which the holder (3) is a box.

11. The device according to claim 1, in which the holder (3) is a frame (8).

12. The device according to claim 1, in which the container (5) and/or the cover (6) has a wall thickness of 0.05 mm to 1.0 mm.

13. The device according to claim 1, in which the perforated plate (4) is produced from polypropylene and/or the container (5) from polypropylene or polyethylene and/or the cover (6) from polypropylene or polyethylene and/or the holder (3) from polycarbonate.

14. The device according to claim 1, in which the perforated plate (4) is injection-moulded and/or the container (5) is deep-drawn or injection-moulded or a blister pack and/or in which the cover (6) is deep-drawn or injection-moulded and/or in which the holder (3) is injection-moulded.

15. The device according to claim 1, in which the refill pack (2) is enclosed in a removable pouch and/or in a removable shrink wrap film.

16. The device according to claim 2, in which the container (5) has a stiffness of up to 100 N/mm.

17. The device according to claim 3, in which the container (5) has a stiffness of at least 40 N/mm.

18. A device for providing pipette tips comprising:

a refill pack that includes:

a perforated plate that defines a plurality of holes, a plurality of pipette tips, each inserted into one of the plurality of holes, a container containing the plurality of pipette tips, the container having a stiffness of up to 300 N/mm, and a removable cover covering the plurality of pipette tips;

a holder with a receiver for receiving the refill pack, the holder comprising side walls and a lid mounted via lateral plates with bearing eyes on bearing pins that protrude outwardly from the side walls, means for supporting the refill pack when said refill pack is inserted into the receiver; and a first means for latching the container, perforated plate, and holder when the refill pack is arranged in the receiver.

19. The device according to claim 1, wherein the first means for latching (12, 13.1, 13.2, 20, 32) latches the container (5) along with perforated plate (4) and holder (3) when the refill pack is arranged in the receiver (26).

20. The device according to claim 19, in which the first means for latching (12, 20) the perforated plate (4) and container (5) comprise latching tabs (12) protruding downwards from two opposing edges of the perforated plate, with outwardly protruding latching lugs (13.1, 13.2) and recesses in side walls (14.1, 14.2) of the container (5) receiving the latching lugs (13.1, 13.2).

21. The device according to claim 19, in which the first means for latching (20, 32) the container 5 and holder (3) comprise outwardly protruding portions (20) in side walls (14.1, 14.2) of the container (5) and the holder (3) further comprises resilient latching hooks (32) overlapping the outwardly protruding portions (20).

22. The device according to claim 21, in which the outwardly protruding portions (20) in the side walls (14.1, 14.2) of the container (5) are integrally formed with the recesses for receiving the resilient latching hooks (32).

* * * * *